US009226540B2

(12) United States Patent
Podhajny

(10) Patent No.: US 9,226,540 B2
(45) Date of Patent: Jan. 5, 2016

(54) METHOD OF KNITTING A KNITTED COMPONENT WITH A VERTICALLY INLAID TENSILE ELEMENT

(71) Applicant: Nike, Inc., Beaverton, OR (US)

(72) Inventor: Daniel A. Podhajny, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 237 days.

(21) Appl. No.: 13/781,336

(22) Filed: Feb. 28, 2013

(65) Prior Publication Data

US 2014/0237861 A1 Aug. 28, 2014

(51) Int. Cl.

| | |
|---|---|
| ***D04B 7/12*** | (2006.01) |
| ***A43B 1/04*** | (2006.01) |
| ***A43B 23/02*** | (2006.01) |
| ***D04B 1/22*** | (2006.01) |
| ***D04B 1/12*** | (2006.01) |
| ***D04B 15/56*** | (2006.01) |

(52) U.S. Cl.

CPC ..... *A43B 1/04* (2013.01); *A43B 23/0245* (2013.01); *D04B 1/123* (2013.01); *D04B 1/22* (2013.01); *D04B 15/56* (2013.01); *D10B 2403/02412* (2013.01); *D10B 2403/032* (2013.01)

(58) Field of Classification Search

CPC ..... A43B 1/04; D04B 1/123; D04B 1/14; D04B 1/22; D04B 19/42

See application file for complete search history.

(56) References Cited

U.S. PATENT DOCUMENTS

| | | | | |
|---|---|---|---|---|
| 1,576,592 A | * | 3/1926 | Fox | 66/190 |
| 2,009,361 A | * | 7/1935 | Lawson | 66/169 R |
| 2,018,275 A | * | 10/1935 | Markowitz | 66/190 |
| 2,147,197 A | | 2/1939 | Glidden | |
| 2,250,588 A | * | 7/1941 | Lombardi | 66/201 |
| 2,264,213 A | * | 11/1941 | Larkin | 66/190 |
| 2,314,098 A | | 3/1943 | McDonald | |

(Continued)

FOREIGN PATENT DOCUMENTS

| | | |
|---|---|---|
| DE | 1084173 | 6/1960 |
| DE | 19738433 | 4/1998 |

(Continued)

OTHER PUBLICATIONS

Declaration of Dr. Edward C. Frederick from the US Patent and Trademark Office Inter Partes Review of U.S. Pat. No. 7,347,011 (178 pp).

(Continued)

*Primary Examiner* — Danny Worrell
*Assistant Examiner* — Megan Brandon
(74) *Attorney, Agent, or Firm* — Brinks Gilson & Lione

(57) ABSTRACT

A knitted component for an article of footwear having a vertically inlaid tensile element is described. The vertically inlaid tensile element extends along a direction that is vertical or at an angle to the direction of the knitting process of the knitted component. A method of knitting the knitted component includes placing a quantity of a tensile element into an auxiliary element of the knitted component and vertically inlaying a tensile element by using needles of a knitting machine to hold the tensile element by loops while the remaining portion of the knitted component is formed. As the knitted component is formed along a horizontal direction on the needles of the knitting machine, the tensile element spools out from within the auxiliary element to form the vertically inlaid tensile element.

21 Claims, 32 Drawing Sheets

(56) References Cited

U.S. PATENT DOCUMENTS

| | | | | | |
|---|---|---|---|---|---|
| 2,320,989 | A | * | 6/1943 | Weinberg | 66/12 |
| 2,343,390 | A | | 3/1944 | Ushakoff | |
| 2,440,393 | A | * | 4/1948 | Clark | 12/142 G |
| 2,569,764 | A | | 10/1951 | Jonas | |
| 2,608,078 | A | * | 8/1952 | Anderson | 66/176 |
| 2,641,004 | A | | 6/1953 | Whiting et al. | |
| 2,780,931 | A | * | 2/1957 | Lawson et al. | 66/14 |
| 3,115,693 | A | * | 12/1963 | Chandler | 156/148 |
| 3,424,220 | A | * | 1/1969 | Schuerch | 152/339.1 |
| 3,583,081 | A | | 6/1971 | Hayashi | |
| 3,964,277 | A | * | 6/1976 | Miles | 66/190 |
| 4,183,993 | A | * | 1/1980 | Benstead et al. | 442/314 |
| 4,447,967 | A | | 5/1984 | Zaino | |
| 4,750,339 | A | | 6/1988 | Simpson et al. | |
| 4,756,098 | A | | 7/1988 | Boggia | |
| 4,785,558 | A | | 11/1988 | Shiomura | |
| 4,813,158 | A | | 3/1989 | Brown | |
| 4,838,045 | A | * | 6/1989 | Cournoyer et al. | 66/196 |
| 5,345,638 | A | | 9/1994 | Nishida | |
| 5,356,701 | A | * | 10/1994 | Wei et al. | 442/6 |
| 5,429,555 | A | * | 7/1995 | Beckh | 474/267 |
| 5,615,562 | A | * | 4/1997 | Roell | 66/126 R |
| 6,333,105 | B1 | | 12/2001 | Tanaka et al. | |
| 8,536,076 | B1 | * | 9/2013 | Byles | 442/312 |
| 2002/0148258 | A1 | | 10/2002 | Cole et al. | |
| 2005/0193592 | A1 | * | 9/2005 | Dua et al. | 36/45 |
| 2008/0110048 | A1 | * | 5/2008 | Dua et al. | 36/45 |
| 2008/0110049 | A1 | * | 5/2008 | Sokolowski et al. | 36/50.1 |
| 2010/0154256 | A1 | * | 6/2010 | Dua | 36/25 R |
| 2012/0233882 | A1 | * | 9/2012 | Huffa et al. | 36/45 |
| 2012/0234051 | A1 | | 9/2012 | Huffa | |
| 2012/0234052 | A1 | * | 9/2012 | Huffa et al. | 66/64 |
| 2012/0255201 | A1 | | 10/2012 | Little | |

FOREIGN PATENT DOCUMENTS

| | | |
|---|---|---|
| DE | 19728848 | 1/1999 |
| EP | 0448714 | 10/1991 |
| EP | 0728860 | 8/1996 |
| EP | 0758693 | 2/1997 |
| EP | 1233091 | 8/2002 |
| FR | 2171172 | 9/1973 |
| GB | 538865 | 8/1941 |
| GB | 1603487 | 11/1981 |
| JP | H06113905 | 4/1994 |
| JP | H08109553 | 4/1996 |
| JP | H11302943 | 11/1999 |
| NL | 7304678 | 10/1974 |
| WO | 9003744 | 4/1990 |
| WO | 0032861 | 6/2000 |
| WO | 0231247 | 4/2002 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

Letter from Bruce Huffa dated Dec. 23, 2013 (71 Pages).

International Search Report and Written Opinion mailed Aug. 6, 2014 in International Application No. PCT/US2014/018840.

* cited by examiner

METHOD OF KNITTING A KNITTED COMPONENT WITH A VERTICALLY INLAID TENSILE ELEMENT

BACKGROUND

The present invention relates generally to articles of footwear, and, in particular, to an article of footwear incorporating a knitted component with a vertically inlaid tensile element.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally used in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements used in the upper, therefore, waste may be decreased while increasing the manufacturing efficiency and recyclability of the upper.

Reducing the number of material elements in an upper may increase the need to include features that provide strength, support, and/or stability to the upper. Therefore, there exists a need for an article of footwear that incorporates a knitted component with a vertically inlaid tensile element.

SUMMARY

Various configurations of an article of footwear may have an upper and a sole structure secured to the upper. A knitted component including a knit element and a tensile element is incorporated into an upper for the article of footwear. The knit element defines a portion of an exterior surface of the upper and an opposite interior surface of the upper, with the interior surface defining a void for receiving a foot. A knitting method is used to form a vertically inlaid tensile element within the knit element to assist with providing strength, support, and/or stability to the upper.

In one aspect, the invention provides a method of knitting comprising: producing a knit element by manipulating at least one yarn to form a plurality of courses and wales along a first direction; and holding at least one tensile element disposed through the knit element in a fixed position along a second direction that is different from the first direction as at least a portion of the plurality of courses and wales of the knit element are produced.

In another aspect, the invention provides a method of manufacturing a knitted component for an article of footwear, the method comprising: providing a knitting machine having a first feeder that dispenses a first yarn and a needle bed that includes a plurality of needles; moving at least the first feeder along the needle bed in a first direction to form a first course of the knitted component from the yarn; holding a tensile element in a fixed position using at least one needle of the plurality of needles; moving at least the first feeder along the needle bed in the first direction to form a second course of the knitted component while the tensile element is being held in the fixed position by the at least one needle; wherein the tensile element is held by the at least one needle in the fixed position along a second direction that is different from the first direction the first feeder moves along the needle bed to form the second course.

In another aspect, the invention provides a method of knitting comprising: producing a knit element by manipulating at least one yarn to form a plurality of courses and wales along a first direction; holding at least one first tensile element disposed through the knit element in a fixed position along a second direction that is approximately perpendicular to the first direction as at least a portion of the plurality of courses and wales of the knit element are produced; and inlaying at least one second tensile element within the portion of the plurality of courses of the knit element along the first direction.

In another aspect, the invention provides a knitted component for an article of footwear comprising a knit element and at least one tensile element, the knitted component prepared by a process comprising the steps of: producing the knit element by manipulating at least one yarn to form a plurality of courses and wales along a first direction; and holding the at least one tensile element disposed through the knit element in a fixed position along a second direction that is different from the first direction as at least a portion of the plurality of courses and wales of the knit element are produced.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be used in a variety of products, an article of footwear that incorporates one of the knitted components is disclosed below as an example. In addition to footwear, the knitted components may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be used in bed coverings (e.g., sheets, blankets), table coverings, towels, flags, tents, sails, and parachutes. The knitted components may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Knitted Component Configurations

The Figures illustrate various embodiments of knitted components that include an upper formed from a knit element and a vertically inlaid tensile element, and a method of forming a knitted component having a knit element and vertically inlaid tensile element. In some embodiments, any one or more of the knitted components described and/or illustrated herein may be incorporated into an article of footwear.

Figure 1:
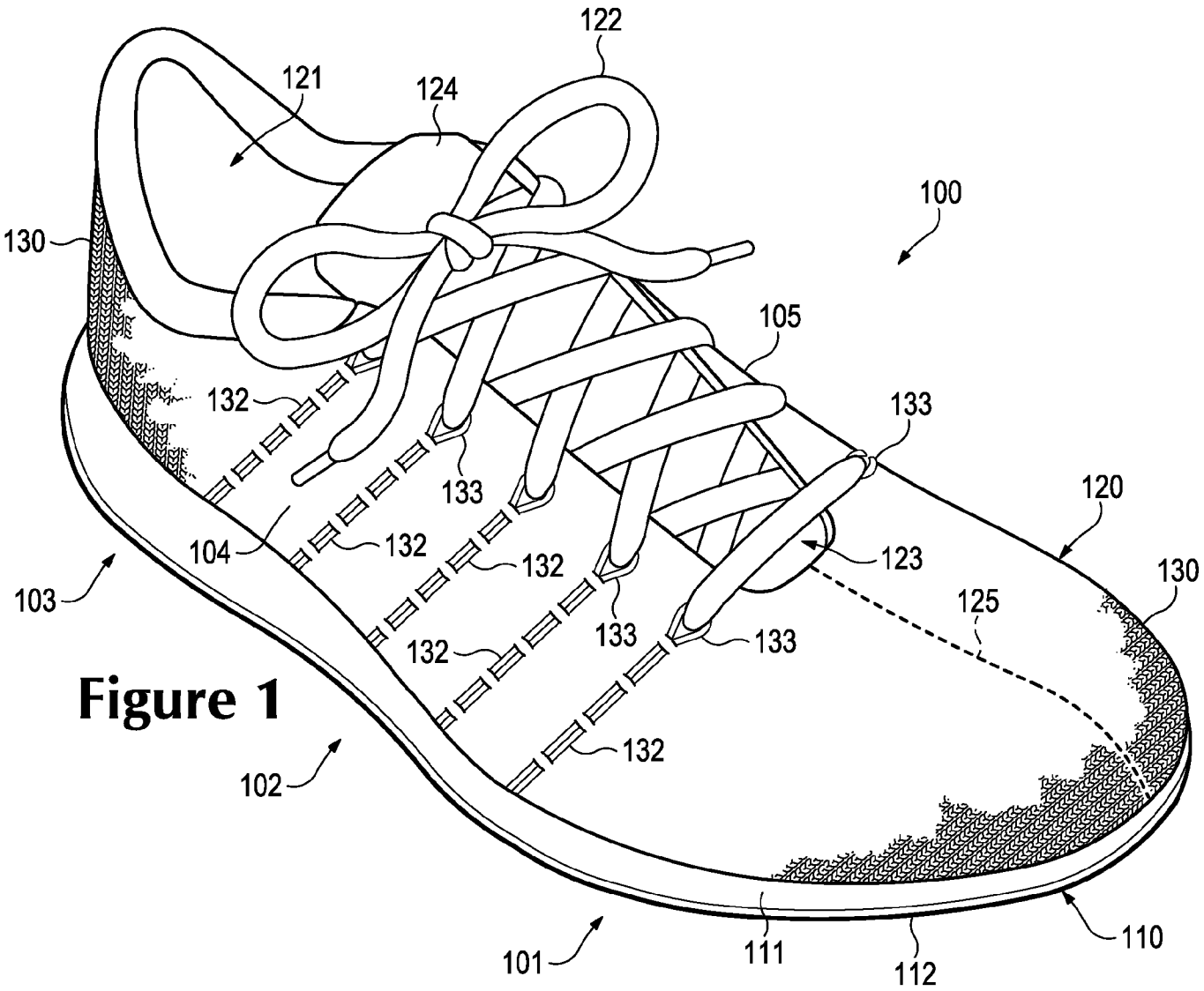
FIG. 1 is an isometric view of an exemplary embodiment of an article of footwear with a knitted component having a vertically inlaid tensile element.
Figure 2:
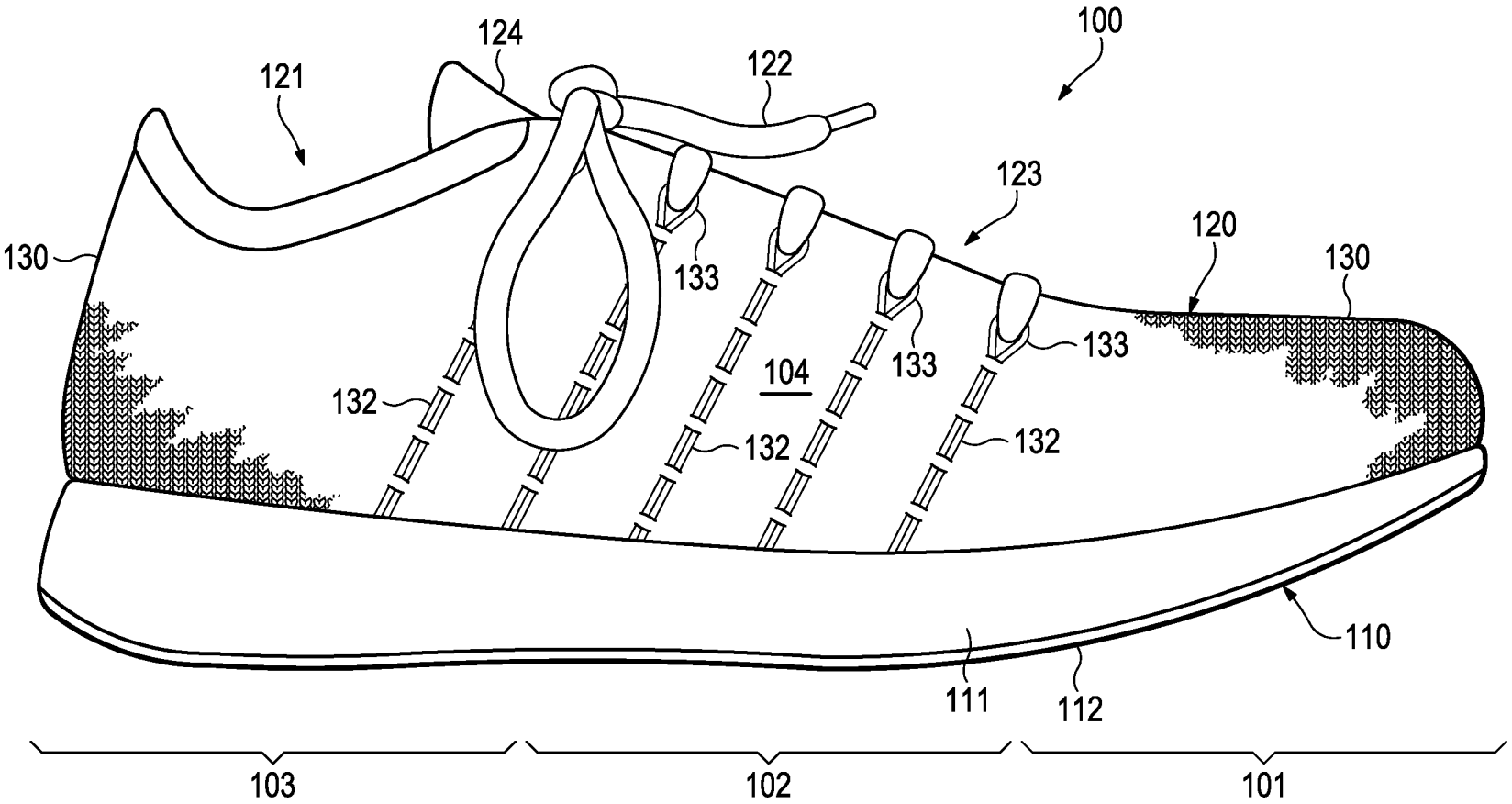
FIG. 2 is a lateral side view of an exemplary embodiment of the article of footwear.
Figure 3:
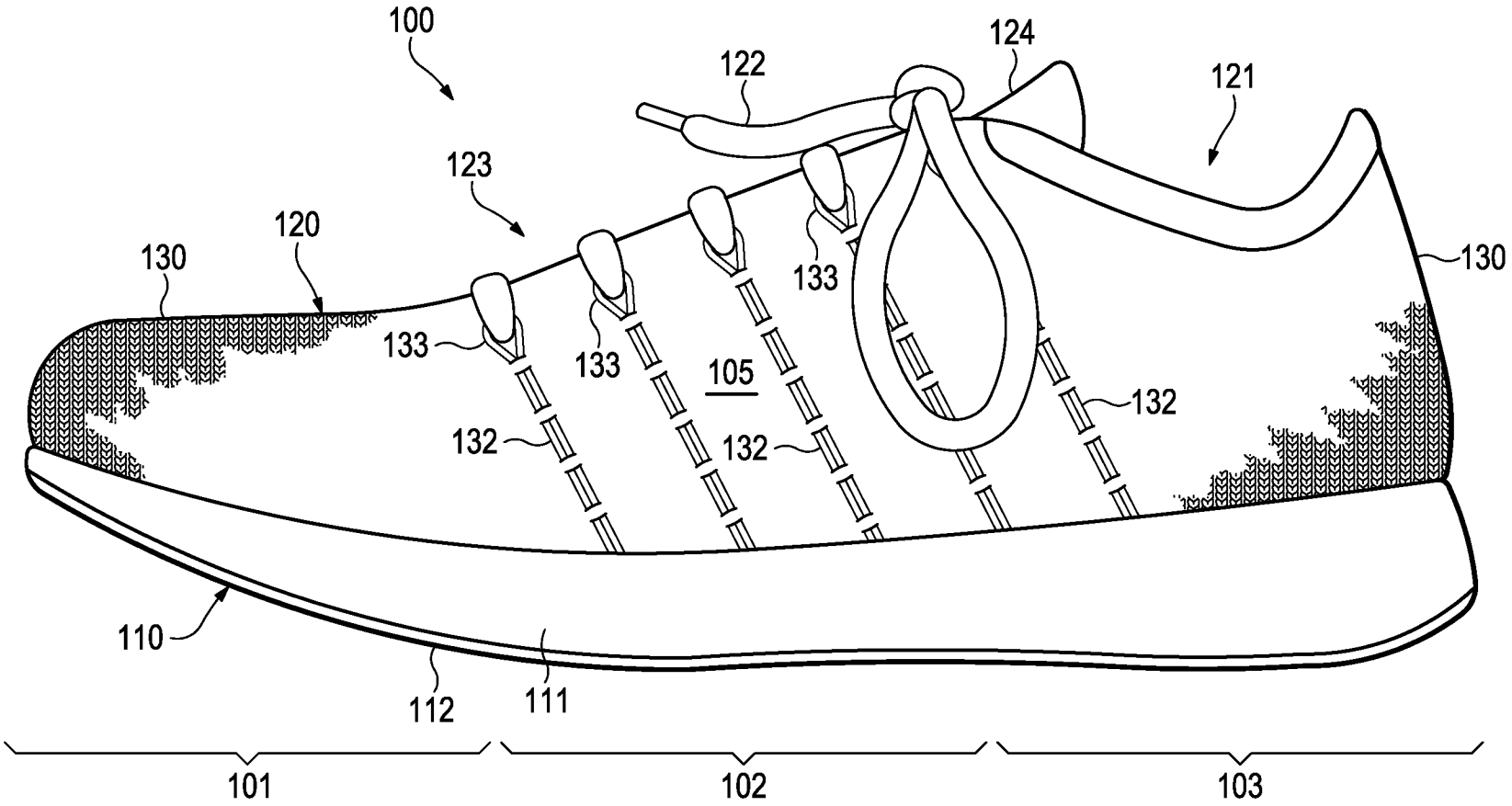
FIG. 3 is a medial side view of an exemplary embodiment of the article of footwear.

FIGS. 1 through 3 illustrate an exemplary embodiment of an article of footwear 100, also referred to simply as footwear 100. In some embodiments, article of footwear 100 may include a sole structure 110 and an upper 120. Although footwear 100 is illustrated as having a general configuration suitable for running, concepts associated with footwear 100 may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear 100 may be applied to a wide variety of footwear types.

For reference purposes, footwear 100 may be divided into three general regions: a forefoot region 101, a midfoot region 102, and a heel region 103, as shown in FIGS. 1, 2, and 3. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Forefoot region 101, midfoot region 102, and heel region 103 and lateral side 104, medial side 105 are not intended to demarcate precise areas of footwear 100. Rather, forefoot region 101, midfoot region 102, and heel region 103 and lateral side 104, medial side 105 are intended to represent general areas of footwear 100 to aid in the following discussion. In addition to footwear 100, forefoot region 101, midfoot region 102, and heel region 103 and lateral side 104, medial side 105 may also be applied to sole structure 110, upper 120, and individual elements thereof.

In an exemplary embodiment, sole structure 110 is secured to upper 120 and extends between the foot and the ground when footwear 100 is worn. In some embodiments, the primary elements of sole structure 110 are a midsole 111, an outsole 112, and a sockliner (not shown) disposed within the interior of footwear 100. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other embodiments, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. The sockliner can be located within upper 120 and be positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

In some embodiments, upper 120 defines a void within footwear 100 for receiving and securing a foot relative to sole structure 110. The void is shaped to accommodate the foot and extends along a lateral side of the foot, along a medial side of the foot, over the foot, around the heel, and under the foot. Access to the void is provided by an ankle opening 121 located in at least heel region 103. In some embodiments, a throat area 123 extends from ankle opening 121 in heel region 103 over an area corresponding to an instep of the foot to an area adjacent to forefoot region 101. In an exemplary embodiment, a vertically inlaid tensile element 132 may be associated with portions of upper 120, as will be described in more detail below. In one embodiment, vertically inlaid tensile element 132 extend from sole structure 110 to an area adjacent to throat area 123 and may be associated with portions of lateral side 104 and/or medial side 105 of upper 120.

A lace 122 extends through various lace apertures 133 in upper 120 and/or looped portions of tensile element 132 and permits the wearer to modify dimensions of upper 120 to accommodate proportions of the foot. More particularly, lace 122 permits the wearer to tighten upper 120 around the foot, and lace 122 permits the wearer to loosen upper 120 to facilitate entry and removal of the foot from the void (i.e., through ankle opening 121). In addition, a tongue 124 of upper 120 extends under lace 122 to enhance the comfort of footwear 100. In further configurations, upper 120 may include additional elements, such as (a) a heel counter in heel region 103 that enhances stability, (b) a toe guard in forefoot region 101 that is formed of a wear-resistant material, and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, a majority of upper 120 is formed from a knitted component 130, which extends through each of forefoot region 101, midfoot region 102, and heel region 103, along both lateral side 104 and medial side 105, over forefoot region 101, and around heel region 103. In addition, knitted component 130 forms portions of both an exterior surface and an opposite interior surface of upper 120. As such, knitted component 130 defines at least a portion of the void within upper 120. In some configurations, knitted component 130 may also extend under the foot. In other configurations, a strobel sock may be secured to knitted component 130 and an upper surface of a midsole, thereby forming a portion of upper 120 that extends under a sockliner.

Various embodiments of knitted components made in accordance with the principles disclosed herein may be incorporated into articles of footwear in a similar manner as the exemplary embodiment of FIGS. 1 through 3. Additionally, knitted components having various features may be made in accordance with the knitting processes disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety (collectively referred to herein as the "Knitted Component cases").

Figure 4:
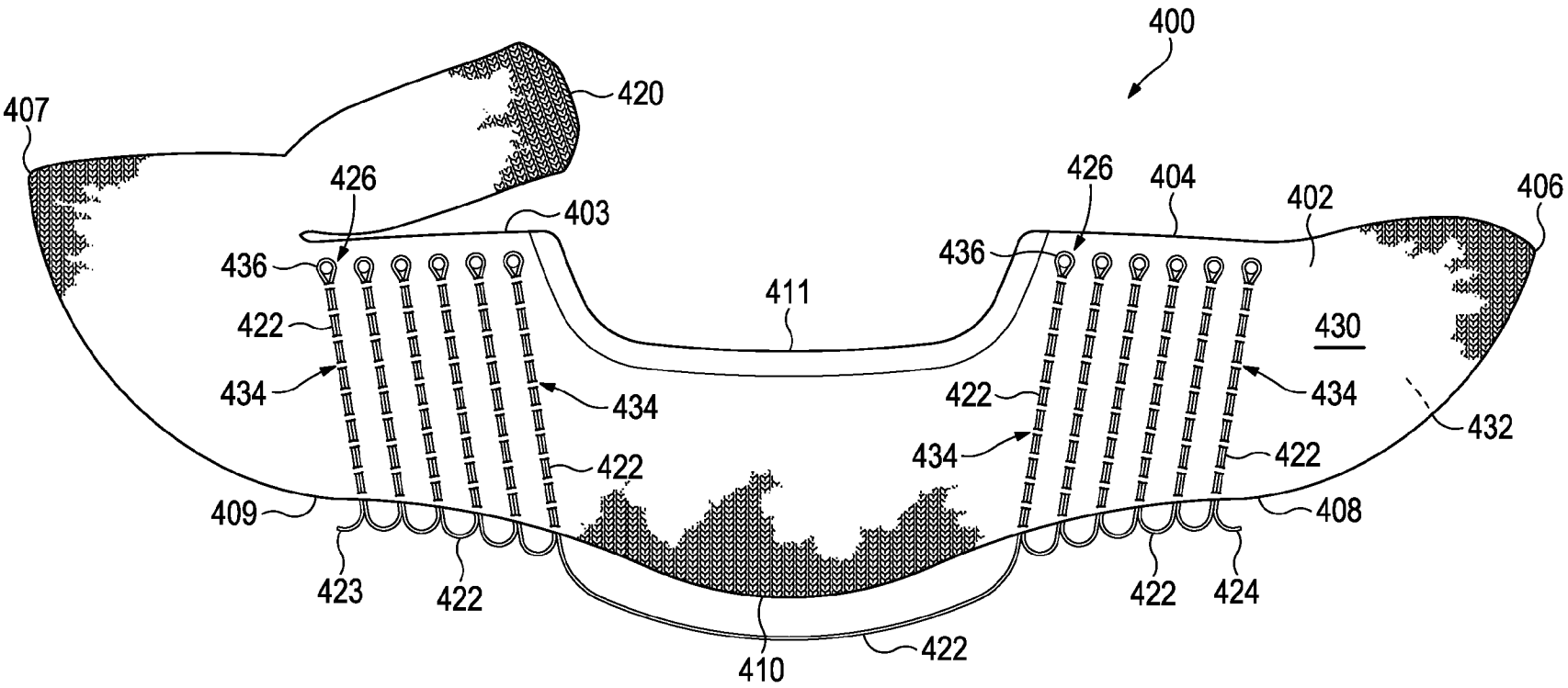
FIG. 4 is a top plan view of an exemplary embodiment of a knitted component with a vertically inlaid tensile element.
Figure 5:
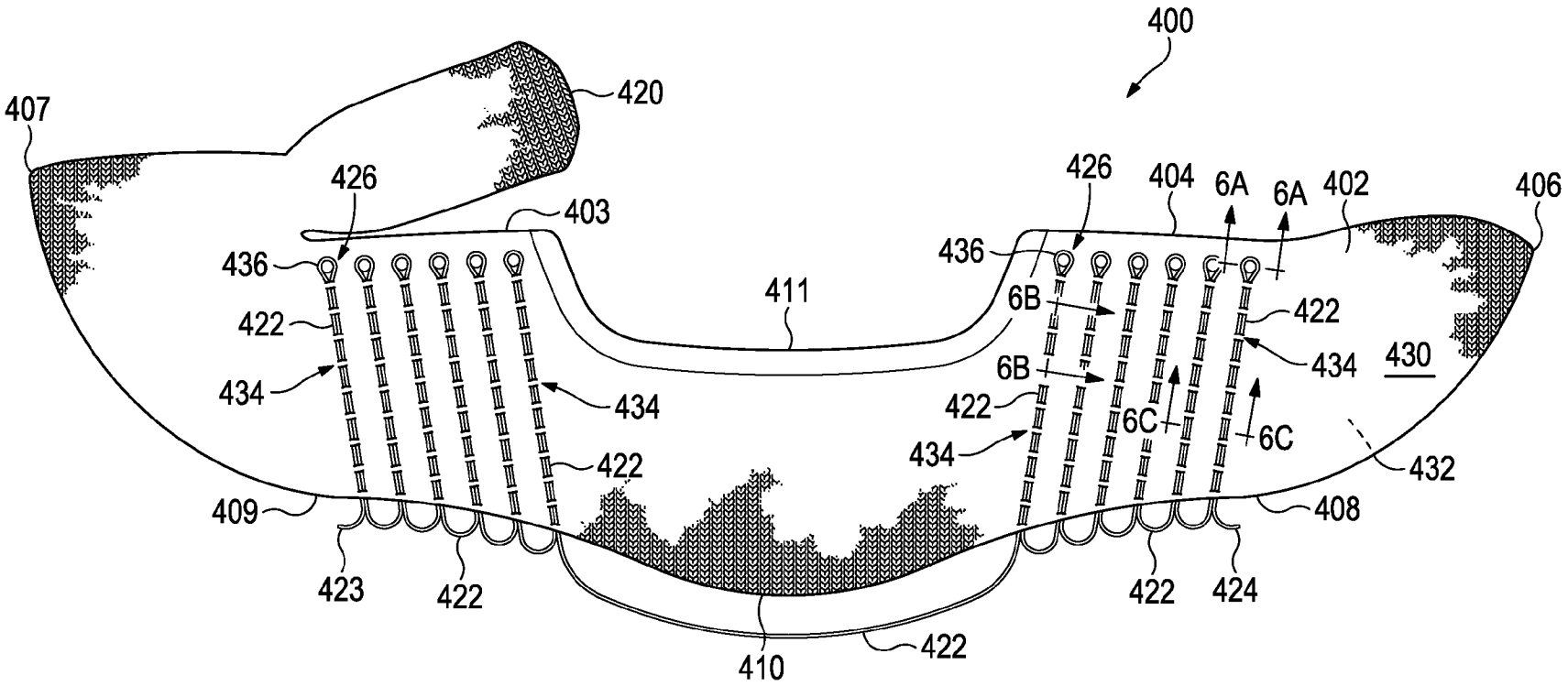
FIG. 5 is a top plan view of an exemplary embodiment of the knitted component with a vertically inlaid tensile element illustrating the location of various section lines 6A-6C.

Referring now to FIGS. 4 and 5, a knitted component 400 is depicted separate from a remainder of footwear 100. Knitted component 400 is formed of unitary knit construction. As used herein and in the claims, a knitted component (e.g., knitted component 400, or other knitted components described herein) is defined as being formed of "unitary knit construction" when formed as a one-piece element through a knitting process. That is, the knitting process substantially forms the various features and structures of knitted component 400 without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 400 may be joined to each other (e.g., edges of knitted component 400 being joined together) following the knitting process, knitted component 400 remains formed of unitary knit construction because it is formed as a one-piece knit element. Moreover, knitted component 400 remains formed of unitary knit construction when other elements (e.g., a lace, logos, trademarks, placards with care instructions and material information, structural elements) are added following the knitting process.

In an exemplary embodiment, the primary elements of knitted component 400 are a knit element 402 and an inlaid tensile element 422. Knit element 402 is formed from at least one yarn that is manipulated (e.g., with a knitting machine) to form a plurality of intermeshed loops that define a variety of courses and wales. That is, knit element 402 has the structure of a knit textile. In an exemplary embodiment, inlaid tensile element 422 extends through knit element 402 and passes between various portions of knit element 402. In some embodiments, inlaid tensile element 422 may be vertically inlaid within knit element 402, as further described below. In other embodiments, a tensile element may also generally extend along courses, wales, or both, within knit element 402. Advantages of inlaid tensile element 422 include providing support, stability, and structure. For example, when knitted component 400 is incorporated into an upper for an article of footwear, inlaid tensile element 422 may assist with securing the upper around the foot, may limit or reduce deformation in areas of the upper (e.g., by imparting stretch-resistance and structure) and may further operate in connection with a lace to enhance the fit of an article of footwear.

In some embodiments, knit element 402 may have a flattened or wide U-shaped configuration. In contrast to a conventional U-shaped configuration for an upper that is arranged along a generally longitudinal direction from a forefoot portion to two heel portions, the flattened or wide U-shaped configuration of knit element 402 is arranged along a generally transverse direction from one side of a forefoot portion through each of a midfoot portion and a heel portion to the opposite side of the forefoot portion. In an exemplary embodiment, the flattened U-shaped configuration of knit element 402 is outlined by a perimeter edge, including a lateral top midfoot perimeter edge 404, a lateral forefoot perimeter edge 406, a lateral bottom midfoot perimeter edge 408, a heel perimeter edge 410, a medial bottom midfoot perimeter edge 409, a medial forefoot perimeter edge 407, a medial top midfoot perimeter edge 403, and an ankle perimeter edge 411. In addition, in some embodiments, knit element 402 may further include a tongue portion 420 that may be formed of unitary knit construction with knit element 402.

When incorporated into an article of footwear, including footwear 100, lateral bottom midfoot perimeter edge 408 and medial bottom midfoot perimeter edge 409, and at least a portion of lateral forefoot perimeter edge 406, heel perimeter edge 410, and medial forefoot perimeter edge 407 lays against an upper surface of a midsole and is joined to a strobel sock (e.g., midsole 111, described above). In addition, portions of lateral forefoot perimeter edge 406 and medial forefoot perimeter edge 407 adjacent to lateral top midfoot perimeter edge 404 and medial top midfoot perimeter edge 403 are joined to each other and extend longitudinally from the forefoot region towards the midfoot region. In some configurations of footwear, a material element may cover a seam between lateral forefoot perimeter edge 406 and medial forefoot perimeter edge 407 to reinforce the seam and enhance the aesthetic appeal of the footwear. Ankle perimeter edge 411 forms an ankle opening, including ankle opening 121 described above.

Knitted component 400 may have a first surface 430 and an opposite second surface 432. First surface 430 forms a portion of the exterior surface of the upper, whereas second surface 432 forms a portion of the interior surface of the upper, thereby defining at least a portion of the void within the upper. Additionally, in some embodiments, knitted component 400 may further include a plurality of lace apertures 436 in knit element 402 that extend through from first surface 430 to second surface 432. In an exemplary embodiment, lace apertures 436 may be configured to receive a lace to assist with adjusting the fit of knit element 402 when incorporated into an article of footwear. In some cases, lace apertures 436 may be a void or opening within knit element 402. In other cases, lace apertures 436 may be a hole or opening that is cut or removed from knit element 402. In still other cases, lace apertures 436 may include additional elements, including, but not limited to loops, grommets, eyelets, eye hooks, or other suitable lace receiving members.

Figure 6A:
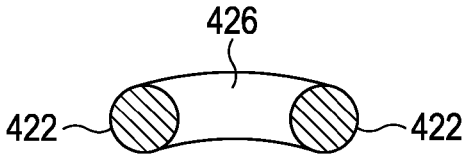
FIG. 6A is a cross-sectional view of the knitted component with a vertically inlaid tensile element, as defined by section line 6A in FIG. 5.
Figure 6B:
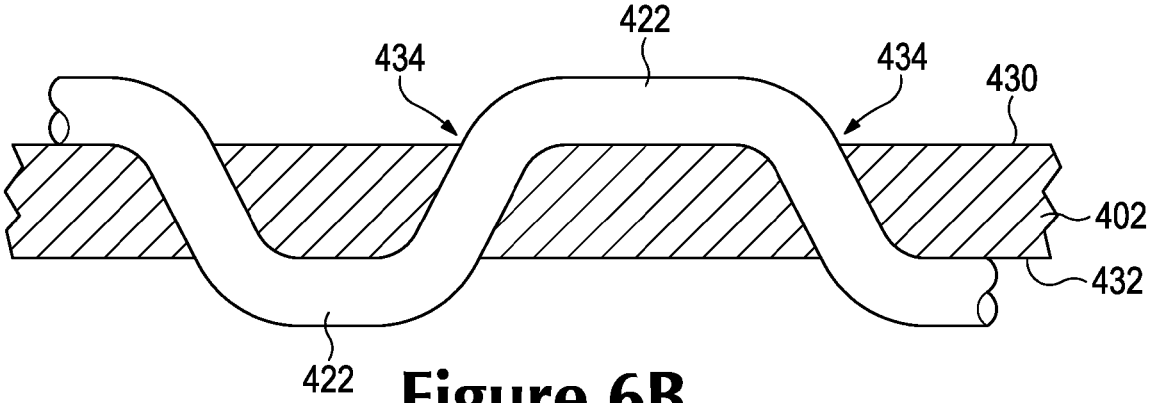
FIG. 6B is a cross-sectional view of the knitted component with a vertically inlaid tensile element, as defined by section line 6B in FIG. 5.
Figure 6C:
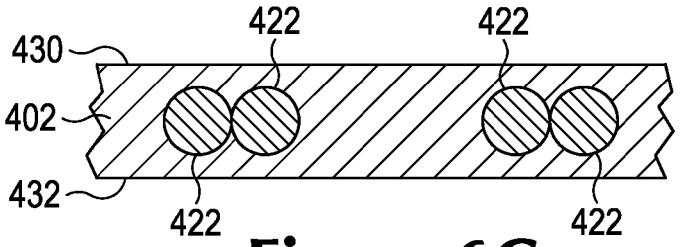
FIG. 6C is a cross-sectional view of the knitted component with a vertically inlaid tensile element, as defined by section line 6C in FIG. 5.

In some embodiments, inlaid tensile element 422 may extend through knit element 402 and pass between various portions of knit element 402. More particularly, inlaid tensile element 422 is located within a portion of the knit structure of knit element 402, which may have the configuration of a single textile layer in the area of inlaid tensile element 422, and between first surface 430 and second surface 432, as depicted in FIGS. 6B and 6C. When knitted component 400 is incorporated into an article of footwear, for example, footwear 100, inlaid tensile element 422 is located between the exterior surface and the interior surface of upper 120. In some configurations, portions of inlaid tensile element 422 may be visible or exposed on one or both of first surface 430 and second surface 432. For example, inlaid tensile element 422 may lay against one of first surface 430 and second surface 432, or knit element 402 may form indentations or apertures through which an inlaid tensile element may pass.

In an exemplary embodiment, inlaid tensile element 422 extends through knit element 402 and passes between various apertures 434 within knit element 402. In one embodiment, inlaid tensile element 422 may alternately pass from one of first surface 430 and second surface 432 of knitted component 400 to the opposite side through apertures 434 so as to be woven through knit element 402, as depicted in FIG. 6B. With this arrangement having inlaid tensile element 422 located between first surface 430 and second surface 432, knit element 402 may protect inlaid tensile element 422 from abrasion and snagging.

Referring to FIGS. 4 and 5, inlaid tensile element 422 repeatedly extends from lateral bottom midfoot perimeter edge 408 and/or medial bottom midfoot perimeter edge 409 towards lateral top midfoot perimeter edge 404 and/or medial top midfoot perimeter edge 403 to a location adjacent to plurality of lace apertures 436. In an exemplary embodiment, inlaid tensile element 422 may include a plurality of looped portions 426 disposed adjacent to lateral top midfoot perimeter edge 404 and/or medial top midfoot perimeter edge 403, where inlaid tensile element 422 turns and extends back towards lateral bottom midfoot perimeter edge 408 and/or medial bottom midfoot perimeter edge 409. FIG. 6A illustrates a cross-section of one of the plurality of looped portions 426 of inlaid tensile element 422.

As discussed above, inlaid tensile element 422 passes back and forth through knit element 402. Referring to FIGS. 4 and 5, inlaid tensile element 422 also repeatedly exits knit element 402 at lateral bottom midfoot perimeter edge 408 and/or medial bottom midfoot perimeter edge 409 and then re-enters knit element 402 at another location of lateral bottom midfoot perimeter edge 408 and/or medial bottom midfoot perimeter edge 409, thereby forming loops along lateral bottom midfoot perimeter edge 408 and/or medial bottom midfoot perimeter edge 409. An advantage to this configuration is that each section of inlaid tensile element 422 that extends between opposing ends of knitted component 400 may be independently tensioned, loosened, or otherwise adjusted during the manufacturing process of an article of footwear. That is, prior to securing a sole structure to upper formed from knitted component 400, sections of inlaid tensile element 422 may be independently adjusted to the proper tension. In one embodiment, inlaid tensile element 422 may be formed of a single tensile element that extends between lateral bottom midfoot perimeter edge 408 and medial bottom midfoot perimeter edge 409 adjacent to heel perimeter edge 410. In other embodiments, inlaid tensile element 422 may include multiple tensile elements, including separate tensile elements associated with each of the lateral and medial sides of a knitted component.

In some embodiments, looped portions 426 of inlaid tensile element 422 may extend at least partially around lace aperture 436. In some cases, looped portions 426 and lace apertures 436 may be configured to cooperatively receive a lace. In other cases, only one of looped portions 426 or lace apertures 436 may receive a lace. Additionally, in some embodiments, looped portions 426 may be joined through knitting or other attachment mechanisms to knit element 402 at lace apertures 436. With this arrangement, looped portions 426 may assist with anchoring inlaid tensile element 422 at a location adjacent to lateral top midfoot perimeter edge 404 and/or medial top midfoot perimeter edge 403 within knit element 402 and prevent inlaid tensile element 422 from being pulled out from knitted component 400.

In comparison with knit element 402, tensile element 422 may exhibit greater stretch-resistance. That is, tensile element 422 may stretch less than knit element 402. Given that numerous sections of tensile element 422 extend from the top area to the bottom area, tensile element 422 may be configured to impart stretch-resistance to a portion of an upper incorporating knitted component 400 between a throat area and a lower area adjacent to a sole structure. Moreover, placing tension upon a lace that is disposed through looped portions 426 may impart tension to inlaid tensile element 422, thereby inducing the portion of upper between the throat area and the lower area to lay against the foot. As such, inlaid tensile element 422 can operate in connection with a lace to enhance the fit of an article of footwear.

In various embodiments, a knit element (for example, knit element 402) may incorporate various types of yarn that impart different properties to separate areas of an upper incorporating a knitted component. That is, one area of a knit element may be formed from a first type of yarn that imparts a first set of properties, and another area of the knit element may be formed from a second type of yarn that imparts a second set of properties. In this configuration, properties may vary throughout the upper by selecting specific yarns for different areas of the knit element. The properties that a particular type of yarn will impart to an area of a knit element partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for a knit element may affect the properties of an upper. For example, a yarn forming a knit element may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of an upper. Accordingly, both the materials forming the yarn and other aspects of the yarn may be selected to impart a variety of properties to separate areas of the upper.

As with the yarns forming a knit element (for example, knit element 402) the configuration of an inlaid tensile element (for example, inlaid tensile element 422) may also vary significantly. In addition to yarn, an inlaid tensile element may have the configurations of a filament (e.g., a monofilament), thread, rope, webbing, cable, or chain, or strand of other suitable material. In comparison with the yarns forming the knit element, the thickness of the inlaid tensile element may be greater. In some configurations, the inlaid tensile element may have a significantly greater thickness than the yarns of the knit element. Although the cross-sectional shape of an inlaid tensile element may be round, triangular, square, rectangular, elliptical, or irregular shapes may also be used. Moreover, the materials forming an inlaid tensile element may include any of the materials for the yarn within a knit element, including, but not limited to: cotton, elastane, polyester, rayon, wool, nylon, and other suitable materials. As noted above, inlaid tensile element 422 may exhibit greater stretch-resistance than knit element 402. As such, suitable materials for inlaid tensile elements may include a variety of engineering filaments that are used for high tensile strength applications, including glass, aramids (e.g., para-aramid and meta-aramid), ultra-high molecular weight polyethylene, and liquid crystal polymer. As another example, a braided polyester thread may also be used as an inlaid tensile element.

Figure 7A:
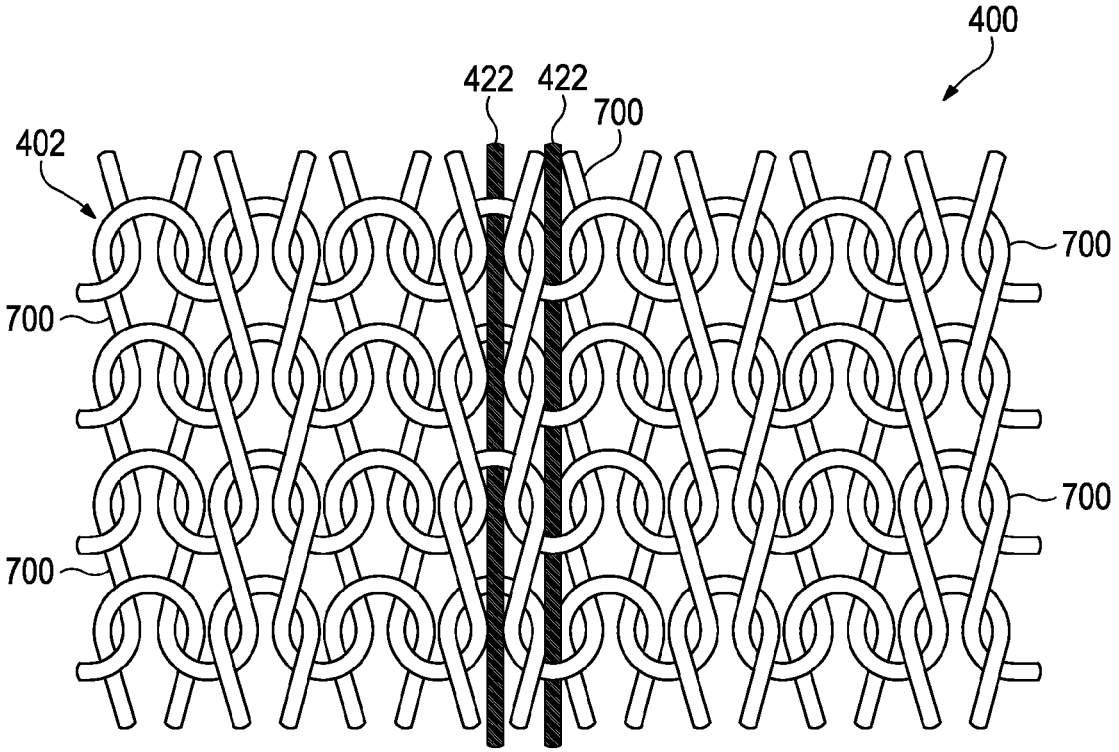
FIGS. 7A and 7B are plan views showing a knit structure with a vertically inlaid tensile element of a knitted component.

An example of a suitable configuration for a portion of knitted component 400 is depicted in FIG. 7A. In this configuration, knit element 402 includes a yarn 700 that forms a plurality of intermeshed loops defining multiple horizontal courses and vertical wales. In this embodiment, inlaid tensile element 422 extends vertically along the direction of one of the wales and extends vertically back along the direction of another of the wales. In an exemplary embodiment, inlaid tensile element 422 may alternate between being located (a) behind loops formed from yarn 700 and (b) in front of loops formed from yarn 700. For example, as shown in FIGS. 4 and 5, inlaid tensile element 422 weaves through the structure formed by knit element 402. Although yarn 700 forms each of the courses in this configuration, additional yarns may form one or more of the courses or may form a portion of one or more of the courses.

Figure 7B:
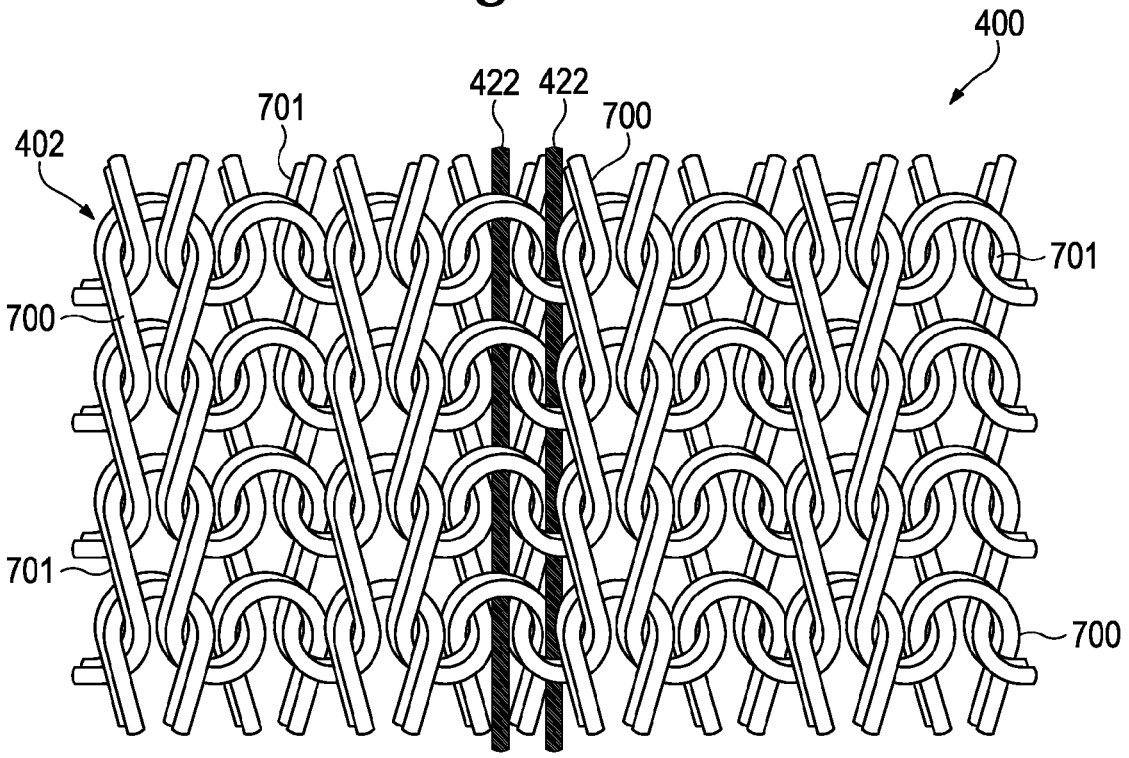

Another example of a suitable configuration for a portion of knitted component 400 is depicted in FIG. 7B. In this configuration, knit element 402 includes first yarn 700 and a second yarn 701. First yarn 700 and second yarn 701 are plated and cooperatively form a plurality of intermeshed loops defining multiple horizontal courses and vertical wales. That is, first yarn 700 and second yarn 701 run parallel to each other. As with the configuration in FIG. 7A, inlaid tensile element 422 extends vertically along the direction of two of the wales and alternates between being located (a) behind loops formed from first yarn 700 and second yarn 701 and (b) in front of loops formed from first yarn 700 and second yarn 701. An advantage of this configuration is that the properties of first yarn 700 and second yarn 701 may be present in this area of knitted component 400. For example, first yarn 700 and second yarn 701 may have different colors, with the color of first yarn 700 being primarily present on a face of the various stitches in knit element 402 and the color of second yarn 701 being primarily present on a reverse of the various stitches in knit element 402. As another example, second yarn 701 may be formed from a yarn that is softer and more comfortable against the foot than first yarn 700, with first yarn 700 being primarily present on first surface 430 and second yarn 701 being primarily present on second surface 432.

Continuing with the configuration of FIG. 7B, in one embodiment, first yarn 700 may be formed from at least one of a thermoset polymer material and natural fibers (e.g., cotton, wool, silk), whereas second yarn 701 may be formed from a thermoplastic polymer material. In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, thermoplastic polymer materials are often used to join two objects or elements together. In this case, second yarn 701 may be used to join (a) one portion of first yarn 700 to another portion of first yarn 700, (b) first yarn 700 and inlaid tensile element 422 to each other, or (c) another element (e.g., logos, trademarks, and placards with care instructions and material information) to knitted component 400, for example. As such, second yarn 701 may be considered a fusible yarn given that it may be used to fuse or otherwise join portions of knitted component 400 to each other. Moreover, first yarn 700 may be considered a non-fusible yarn given that it is not formed from materials that are generally capable of fusing or otherwise joining portions of knitted component 400 to each other. That is, first yarn 700 may be a non-fusible yarn, whereas second yarn 701 may be a fusible yarn. In some configurations of knitted component 400, first yarn 700 (i.e., the non-fusible yarn) may be substantially formed from a thermoset polyester material and second yarn 701 (i.e., the fusible yarn) may be at least partially formed from a thermoplastic polyester material.

The use of plated yarns may impart advantages to knitted component 400. When second yarn 701 is heated and fused to first yarn 700 and inlaid tensile element 422, this process may have the effect of stiffening or rigidifying the structure of knitted component 400. Moreover, joining (a) one portion of first yarn 700 to another portion of first yarn 700 or (b) first yarn 700 and inlaid tensile element 422 to each other has the effect of securing or locking the relative positions of first yarn 700 and inlaid tensile element 422, thereby imparting stretch-resistance and stiffness. That is, portions of first yarn 700 may not slide relative to each other when fused with second yarn 701, thereby preventing warping or permanent stretching of knit element 402 due to relative movement of the knit structure. Another benefit relates to limiting unraveling if a portion of knitted component 400 becomes damaged or one of first yarn 700 is severed. Also, inlaid tensile element 422 may not slide relative to knit element 402, thereby preventing portions of inlaid tensile element 422 from pulling outward from knit element 402. Accordingly, areas of knitted component 400 may benefit from the use of both fusible and non-fusible yarns within knit element 402.

Knitting Process for a Knitted Component

Figure 8:
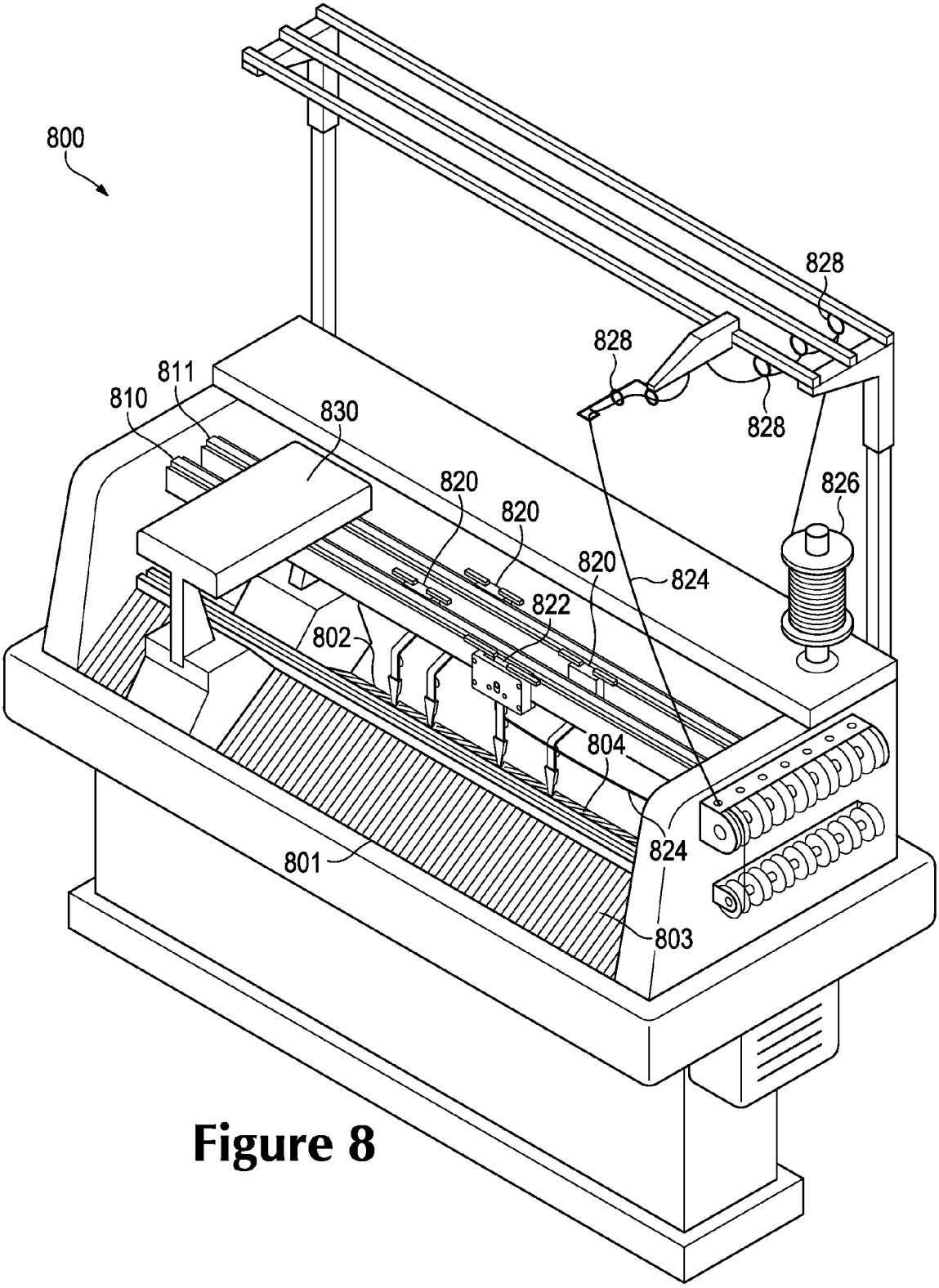
FIG. 8 is a perspective view of an exemplary embodiment of a knitting machine.

Although knitting may be performed by hand, the commercial manufacture of knitted components is generally performed with a knitting process using knitting machines. FIG. 8 illustrates an exemplary embodiment of a knitting machine 800 that is suitable for producing any of the knitted components having vertically inlaid tensile elements described in the embodiments herein, including knitted component 130, knitted component 400, and/or knitted component 1600, described below, as well as other configurations of knitted components not explicitly illustrated or described but made according to the principles described herein. In this embodiment, knitting machine 800 has a configuration of a V-bed flat knitting machine for purposes of example, but any of the knitted components or portions of knitted components may be produced on other types of knitting machines.

In an exemplary embodiment, knitting machine 800 may include two needle beds, including a front needle bed 801 and a back needle bed 802, that are angled with respect to each other, thereby forming a V-bed. Each of front needle bed 801 and back needle bed 802 include a plurality of individual needles that lay on a common plane, including needles 803 associated with front bed 801 and needles 804 associated with back bed 802. That is, needles 803 from front needle bed 801 lay on a first plane, and needles 804 from back needle bed 802 lay on a second plane. The first plane and the second plane (i.e., the two needle beds 801, 802) are angled relative to each other and meet to form an intersection that extends along a majority of a width of knitting machine 800. As described in greater detail below, needles 803, 804 each have a first position where they are retracted and a second position where they are extended. In the first position, needles 803, 804 are spaced from the intersection where the first plane and the second plane meet. In the second position, however, needles 803, 804 pass through the intersection where the first plane and the second plane meet.

A pair of rails, including a forward rail 810 and a rear rail 811, extends above and parallel to the intersection of needle beds 801, 802 and provide attachment points for multiple standard feeders 820 and combination feeders 822. Each rail 810, 811 has two sides, each of which accommodates either one standard feeder 820 or one combination feeder 822. In this embodiment, rails 810, 811 include a front side and a back side. As such, knitting machine 800 may include a total of four feeders 820 and 822. As depicted, the forward-most rail, forward rail 810, includes one combination feeder 822 and one standard feeder 820 on opposite sides, and the rearward-most rail, rear rail 811, includes two standard feeders 820 on opposite sides. Although two rails 810, 811 are depicted, further configurations of knitting machine 800 may incorporate additional rails to provide attachment points for more standard feeders 820 and/or combination feeders 822.

Due to the action of a carriage 830, feeders 820 and 822 move along rails 810, 811 and needle beds 801, 802, thereby supplying yarns to needles 803, 804. As shown in FIG. 8, a yarn 824 is provided to combination feeder 822 by a spool 826. More particularly, yarn 824 extends from spool 826 to various yarn guides 828, a yarn take-back spring, and a yarn tensioner before entering combination feeder 822. Although not depicted, additional spools may be used to provide yarns to feeders 820 in a substantially similar manner as spool 826.

Standard feeders 820 are conventionally-used for a V-bed flat knitting machine, such as knitting machine 800. That is, existing knitting machines incorporate standard feeders 820. Each standard feeder 820 has the ability to supply a yarn that needles 803, 804 manipulate to knit, tuck, and float. As a comparison, combination feeder 822 has the ability to supply a yarn (e.g., yarn 824) that needles 803, 804 knit, tuck, and float, and combination feeder 822 further has the ability to horizontally inlay the yarn. Moreover, combination feeder 822 has the ability to horizontally inlay a variety of different tensile elements, including yarn or other types of strands (e.g., filament, thread, rope, webbing, cable, or chain). Accordingly, combination feeder 822 exhibits greater versatility than each standard feeder 820.

Standard feeders 820 and combination feeder 822 may have substantially similar configurations as the structure of standard feeders and the combination feeder described in U.S. patent application Ser. No. 13/048,527, entitled "Combination Feeder For A Knitting Machine", filed on Mar. 15, 2011, and such feeders may be used with the knitting process to form a knitted component in accordance with the method described in U.S. patent application Ser. No. 13/048,540, entitled "Method Of Manufacturing A Knitted Component", filed on Mar. 15, 2011, each of which applications are hereby incorporated by reference in their entirety (collectively referred to herein as the "Feeder cases").

The manner in which knitting machine 800 operates to manufacture a knitted component will now be discussed in detail. Moreover, the following discussion will demonstrate the operation of one or more standard feeders 820 and/or combination feeders 822 during a knitting process. The knitting process discussed herein relates to the formation of various knitted components, which may be any knitted component, including knitted components that are similar to knitted components in the embodiments described above. For purposes of the discussion, only a relatively small section of a knitted component may be shown in the figures in order to permit the knit structure to be illustrated. Moreover, the scale or proportions of the various elements of knitting machine 800 and a knitted component may be enhanced to better illustrate the knitting process. It should be understood that although a knitted component is formed between needle beds 801, 802, for purposes of illustration in FIGS. 9A-9I and FIGS. 11 through 15, a knitted component is shown adjacent to needle beds 801, 802 to (a) be more visible during discussion of the knitting process and (b) show the position of portions of the knitted component relative to each other and needle beds 801, 802. Also, although one rail, and limited numbers of standard feeders and combination feeders are depicted, additional rails, standard feeders, and combination feeders may be used. Accordingly, the general structure of knitting machine 800 is simplified for purposes of explaining the knitting process.

FIGS. 9A-9I and FIGS. 11 through 15 illustrate various knitting processes that may be used to manufacture a knitted component in accordance with the principles described herein. In various embodiments described, the different knit structures of a particular knitted component may be made using various types of knit structures, including knit types and yarn types.

For purposes of reference, the term "vertically inlaid" is intended to describe the direction of the inlaid tensile element with respect to the direction of the courses that are knit to form the knitted component. That is, the tensile element is inlaid vertically with respect to a generally horizontal knitting direction of the courses forming the remaining portion of the knitted component. In other words, the vertically inlaid tensile element is positioned approximately perpendicular or at an angle to the remaining portion of the knitted component during the knitting process. For example, when knitting on a V-bed flat knitting machine of the type shown in FIG. 8, the tensile element will be positioned approximately vertical with respect to the needle beds and the direction of knitting forming the knitted component.

In some embodiments, a knitting process of forming a knitted component having vertically inlaid tensile elements may include a precursor step of forming a portion of the knitted component that is configured to receive the inlaid tensile element prior to knitting the remaining portion of the knitted component. Accordingly, in an exemplary embodiment, a knitted component may include an auxiliary element that includes the inlaid tensile element disposed within the knit structure of the auxiliary element so that the inlaid tensile element may be vertically extracted or "spooled" out from the auxiliary element as the remaining portion of the knitted component including the knit element is formed.

Referring now to FIGS. 9A through 9I, an exemplary process for forming an auxiliary element 910 that includes an inlaid tensile element is illustrated. In this embodiment, a portion of knitting machine 800 is shown that includes needles 803, 804, forward rail 810, standard feeder 820, and combination feeder 822. It should be understood that additional components of knitting machine 800, as well as additional standard and/or combination feeders, not shown here may be used in similar manner.

Figure 9A:
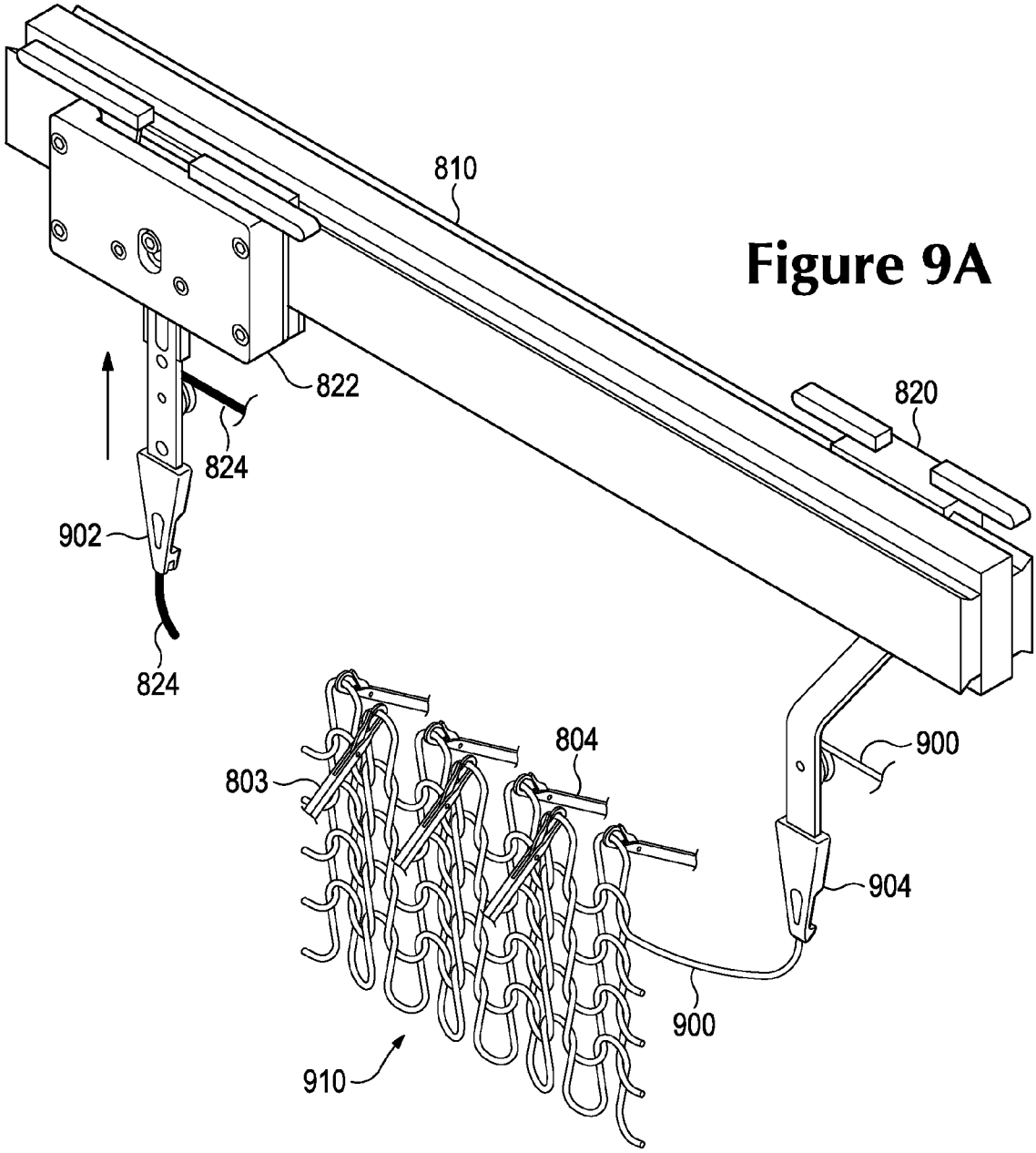
FIGS. 9A through 9I are schematic perspective views of a knitting process to prepare a tensile element to be vertically inlaid in a knitted component.

Additionally, as shown in FIG. 9A, yarn 824 passes through combination feeder 822 and an end of yarn 824 extends outward from dispensing tip 902. In a similar manner, an auxiliary yarn 900 passes through standard feeder 820 and an end of auxiliary yarn 900 extends outward from dispensing tip 904. In this embodiment, yarn 824 is a material suitable for an inlaid tensile element and auxiliary yarn 900 is a material suitable for a knit structure, in this case, knitted auxiliary element 910. In other embodiments, yarn 900 may be the same or similar to any of the yarns used to form the remaining portion of a knitted component including a knit element.

Figure 9B:
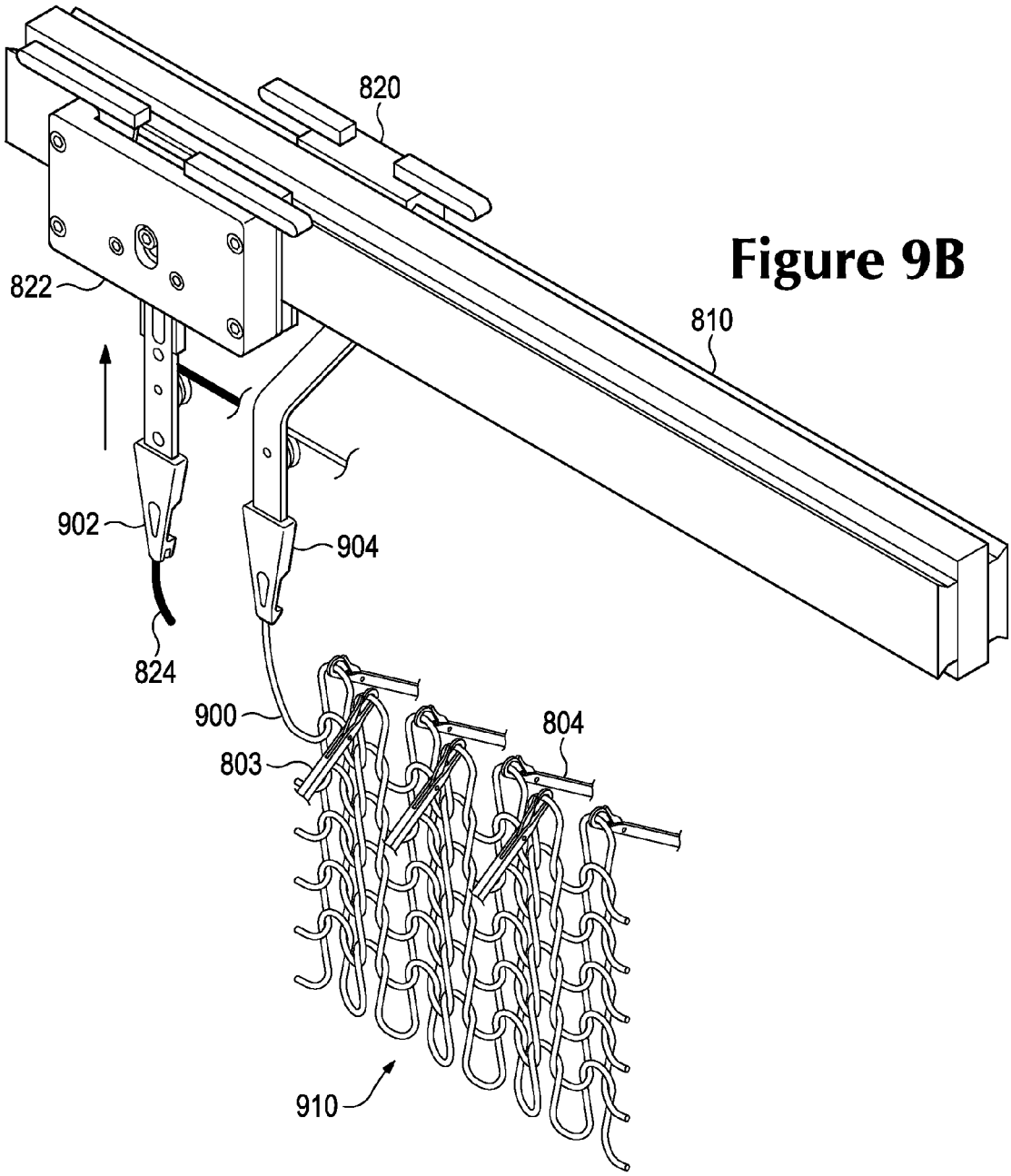

Referring now to FIG. 9B, standard feeder 820 moves along forward rail 810 and a new course is formed in auxiliary element 910 from yarn 900. More particularly, needles 804 pulled sections of yarn 900 through the loops of the prior course, thereby forming the new course. Accordingly, courses may be added to auxiliary element 910 by moving standard feeder 820 along needles 803, 804, thereby permitting needles 803, 804 to manipulate yarn 900 and form additional loops from yarn 900.

Figure 9C:
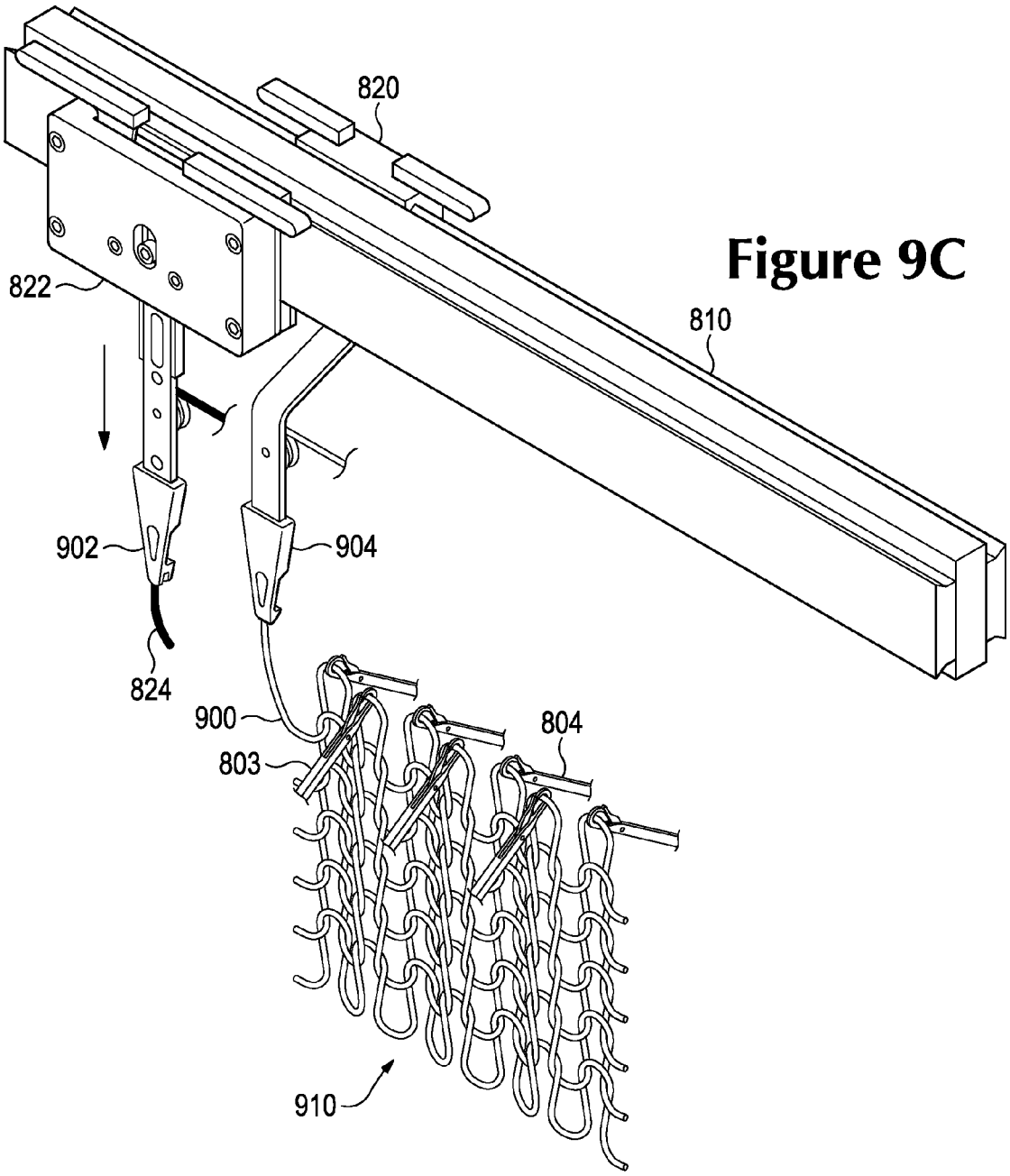

Continuing with the knitting process, the feeder arm of combination feeder 822 now translates from the retracted position to the extended position, as depicted in FIG. 9C. In the extended position, the feeder arm extends downward from combination feeder 822 to position dispensing tip 902 in a location that is (a) centered between needles 803, 804 and (b) below the intersection of front needle bed 801 and back needle bed 802.

Figure 9D:
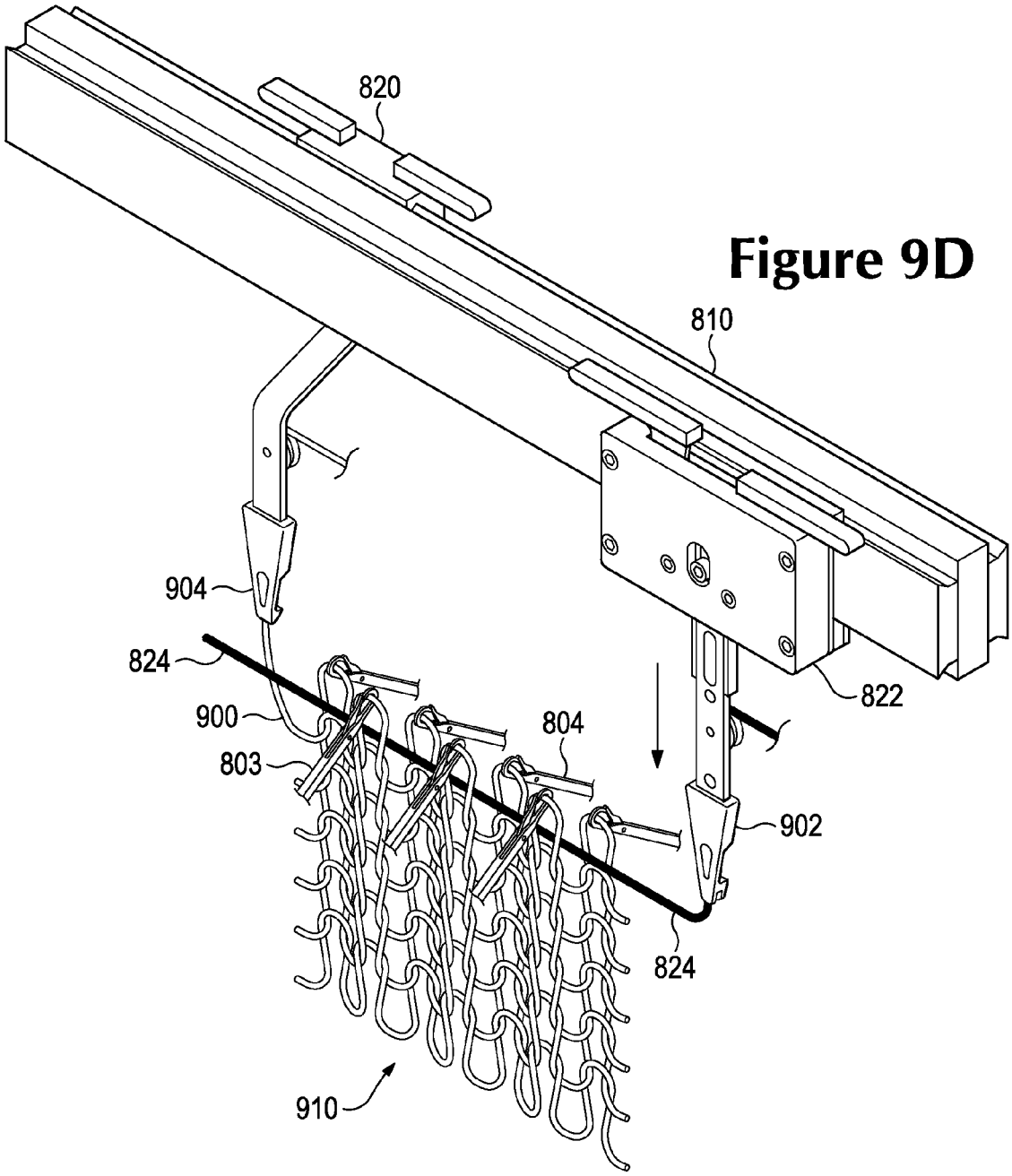

Referring now to FIG. 9D, combination feeder 822 moves along forward rail 810 and yarn 824 is placed between loops of auxiliary element 910. That is, yarn 824 is located in front of some loops and behind other loops in an alternating pattern. Moreover, yarn 824 is placed in front of loops being held by needles 802 from front needle bed 801, and yarn 824 is placed behind loops being held by needles 804 from back needle bed 802. Note that the feeder arm remains in the extended position in order to lay yarn 824 in the area below the intersection of needle beds 801, 802. This effectively places yarn 824 within the course recently formed by standard feeder 820 in FIG. 9B.

Figure 9E:
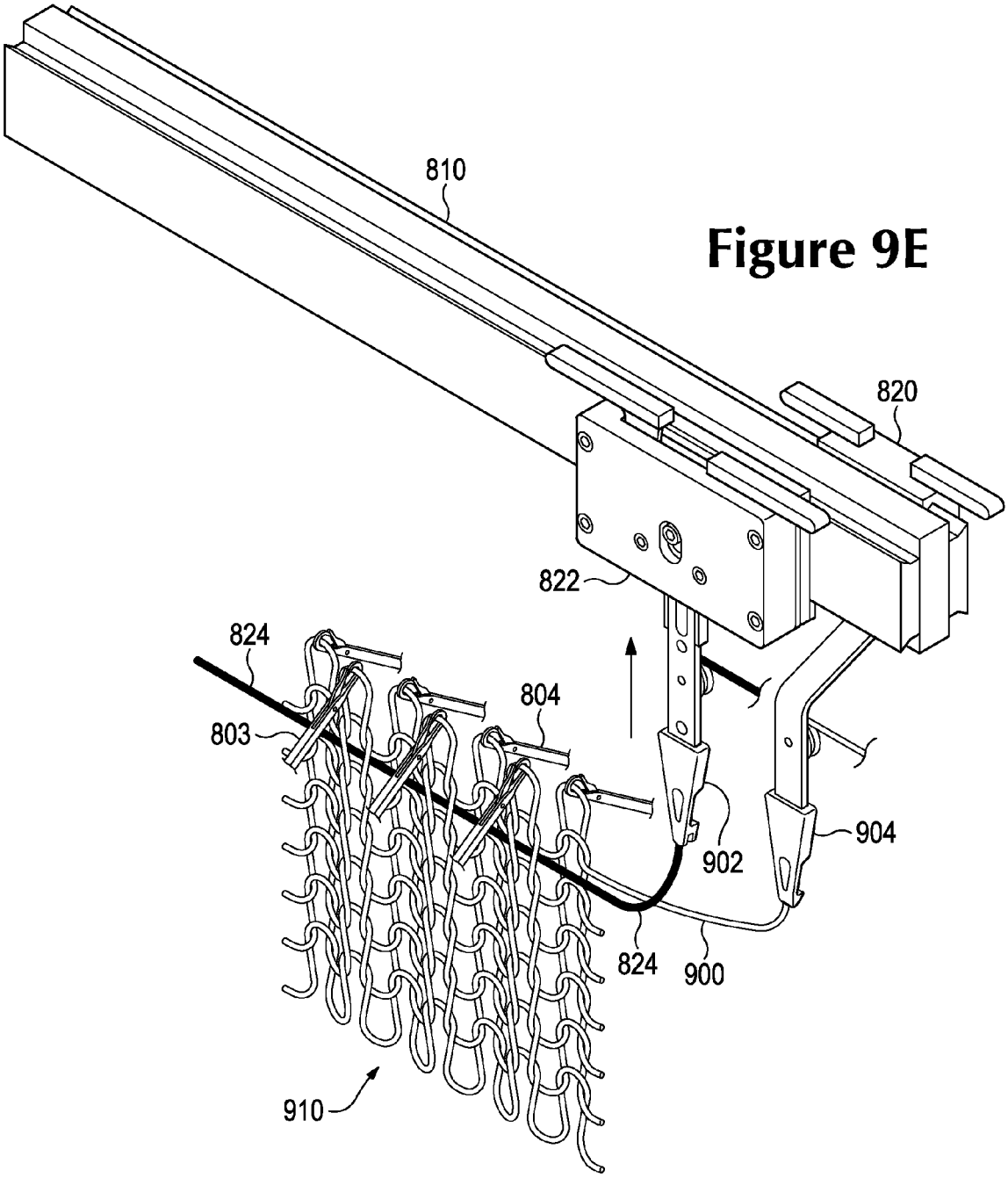

In one embodiment, a knit structure within auxiliary element 910 may form a pocket-like structure that is configured to hold one or more loops of yarn 824 that will be used to form vertically inlaid tensile elements within the knit element of a knitted component. Accordingly, in order to complete inlaying yarn 824 into auxiliary element 910, standard feeder 820 moves along forward rail 810 to form a new course from yarn 900, as depicted in FIG. 9E. By forming the new course, yarn 824 is effectively knit within or otherwise integrated into a pocket-like structure of auxiliary element 910. At this stage, the feeder arm of combination feeder 822 may also translate from the extended position to the retracted position.

FIGS. 9D and 9E show separate movements of feeders 820 and 822 along forward rail 810. That is, FIG. 9D shows a first movement of combination feeder 822 along forward rail 810, and FIG. 9E shows a second and subsequent movement of standard feeder 820 along forward rail 810. In many knitting processes, feeders 820 and 822 may effectively move simultaneously to inlay yarn 824 and form a new course from yarn 900. Combination feeder 822, however, moves ahead or in front of standard feeder 820 in order to position yarn 824 prior to the formation of the new course from yarn 900.

The general knitting process outlined in the above discussion provides an example of the manner in which yarn 824 that may be used to form vertically inlaid tensile elements, including, for example, inlaid tensile elements 122, 422, described above, may be located within pocket-like structures within auxiliary element 910. More particularly, a knitted component having vertically inlaid tensile elements may be formed by first using combination feeder 822 to effectively insert a quantity of yarn 824 within pocket-like knit structures of an auxiliary element that is sufficient to form the vertically inlaid tensile elements extending through a knit element of a completed knitted component. Given the reciprocating action of the feeder arm of combination feeder 822, yarn 824 may be located within a pocket-like knit structure of a previously formed course prior to the formation of a new course of the auxiliary element. By repeating a similar process, additional pocket-like knit structure may then be formed within the auxiliary element. In an exemplary embodiment, a plurality of pocket-like knit structures may be formed in an auxiliary element, including auxiliary element 910.

Figure 9F:
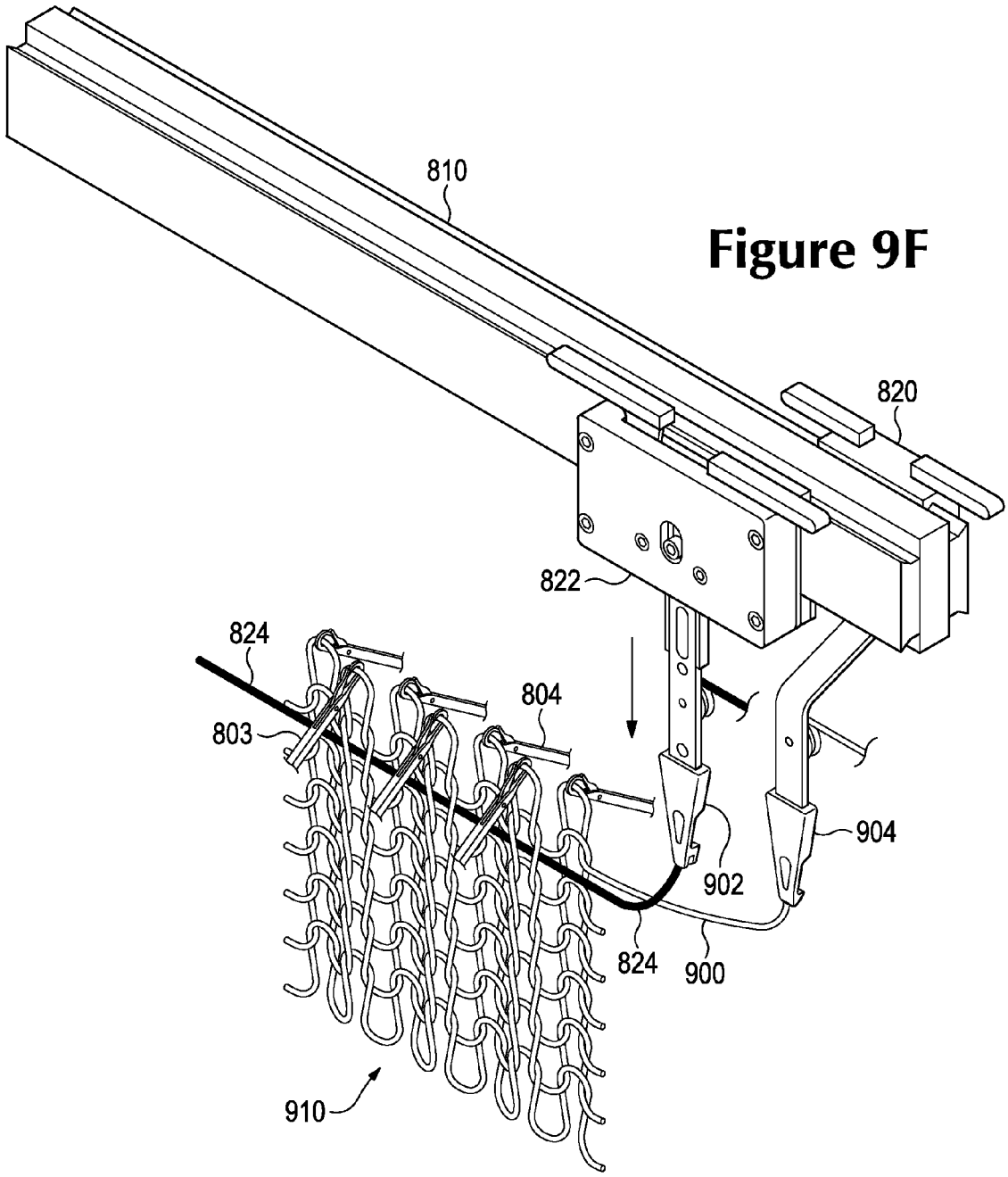
Figure 9G:
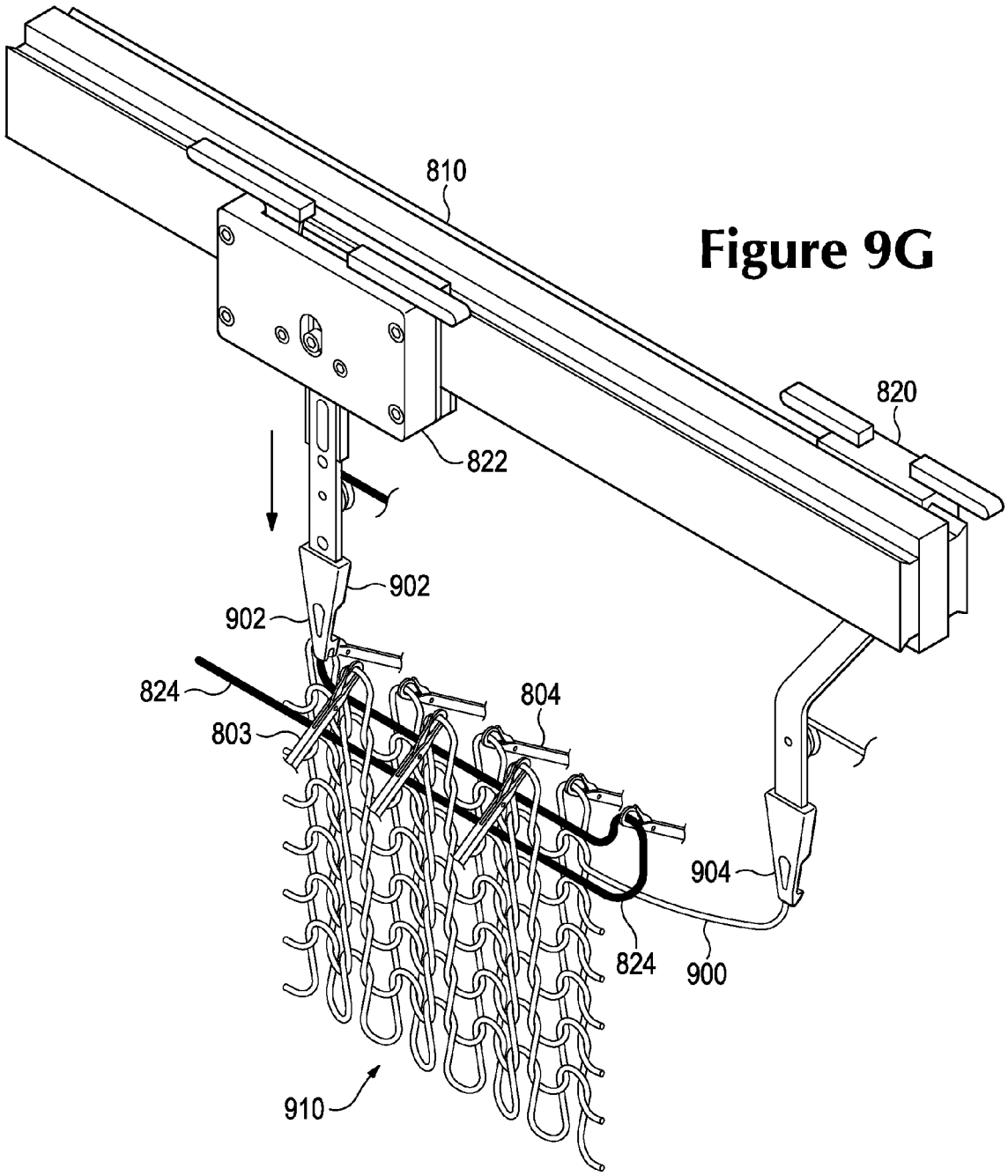
Figure 9H:
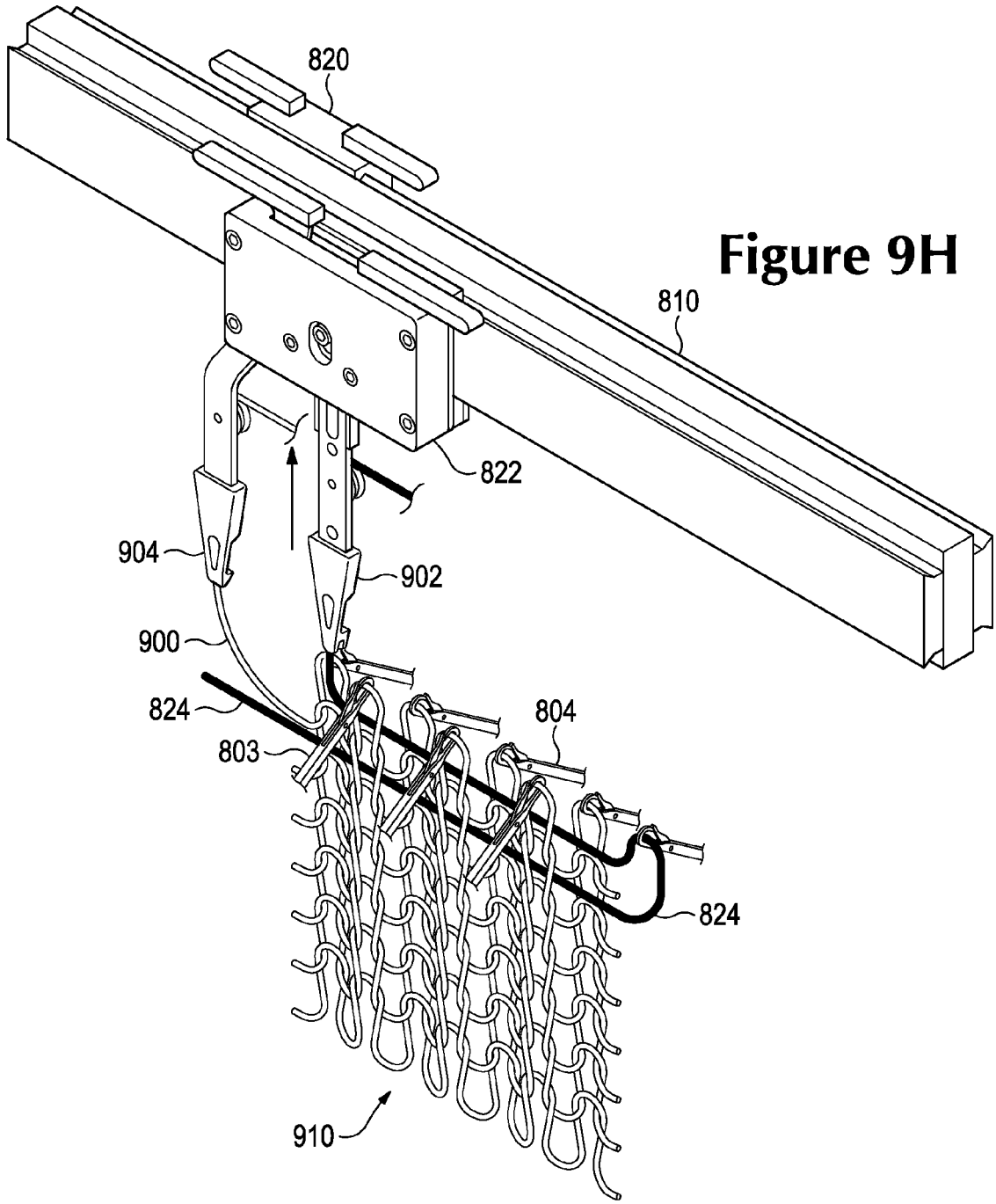

Continuing with the knitting process, the feeder arm of combination feeder 822 now translates from the retracted position to the extended position, as depicted in FIG. 9F. After combination feeder 822 finishes inlaying yarn 824 within auxiliary element 910 as shown in FIG. 9F, a needle may hold a portion of yarn 824 before combination feeder 822 reverses direction and moves along forward rail 810 to continuing inlaying yarn 824 within auxiliary element 910. Accordingly, as depicted in FIG. 9G, as combination feeder 822 moves along forward rail 810 and yarn 824 is placed between loops of auxiliary element 910, a needle is holding a portion of yarn 824 at the location where yarn 824 reverses its direction within auxiliary element 910. This effectively places yarn 824 within the course formed by standard feeder 820 in FIG. 9E and within another pocket-like knit structure in auxiliary element 910. In order to complete inlaying yarn 824 into the pocket-like structures of auxiliary element 910, standard feeder 820 moves along forward rail 810 to form a new course from yarn 900, as depicted in FIG. 9H. By forming the new course, yarn 824 is effectively knit within or otherwise integrated into the pocket-like knit structure of auxiliary element 910. At this stage, the feeder arm of the combination feeder 822 may also translate from the extended position to the retracted position.

Referring to FIG. 9H, yarn 824 forms a loop between the two inlaid sections corresponding to two of the pocket-like knit structures of auxiliary element 910. The process of inlaying yarn 824 within the pocket-like structures of auxiliary element 910 using combination feeder 822 may be repeated until a quantity of yarn 824 has been placed into auxiliary element 910 that corresponds to an extended length of the vertically inlaid tensile element. That is, the quantity of yarn 824 to be inlaid within auxiliary element is selected so that vertically inlaid tensile elements in a knitted component may extend along a knit element to a desired length. For example, a knitted component having six vertically inlaid tensile element portions that extend from approximately 5 cm to 7 cm along an upper, would have a correspondingly similar quantity of yarn 824 inlaid within auxiliary element 910 to permit such a configuration. In addition, in some cases, a slightly greater quantity of yarn may be provided to permit adjustment of length and/or tension of the tensile element.

Figure 9I:
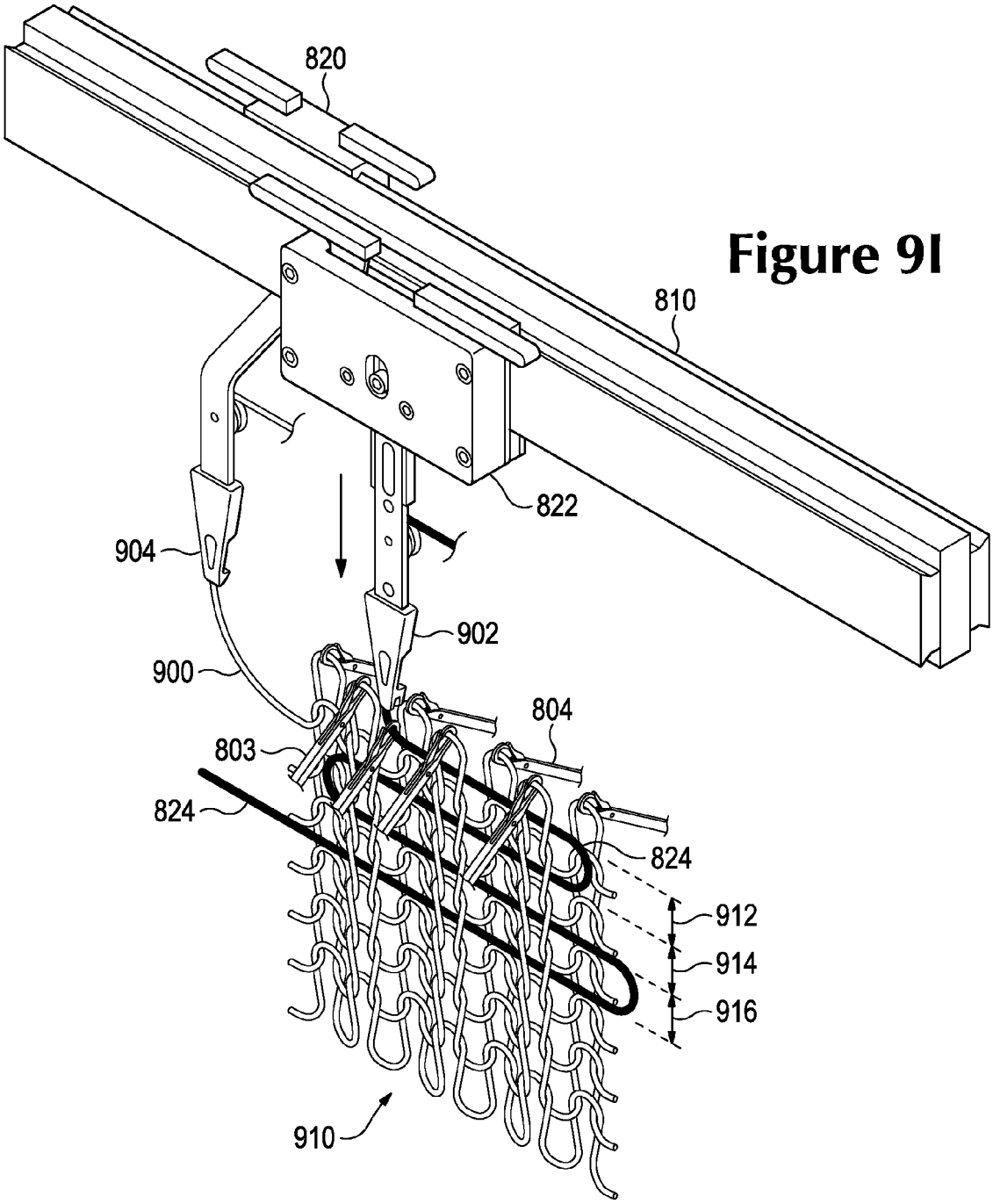

Referring now to FIG. 9I, auxiliary element 910 is shown having multiple pocket-like knit structures formed in consecutive courses containing yarn 824. In this embodiment, auxiliary element includes a first pocket 912 disposed closest to needles 803, 804, a second pocket 914 formed by a different course of yarn 900 forming auxiliary element 910 and disposed below first pocket 912. Similarly, a third pocket 916 is formed by another course of yarn 900 disposed below both of first pocket 912 and second pocket 914. As shown in FIG. 9I, first pocket 912, second pocket 914, and third pocket 916 contain various amounts of yarn 824 disposed through each of the pockets in a substantially continuous manner.

Figure 10:
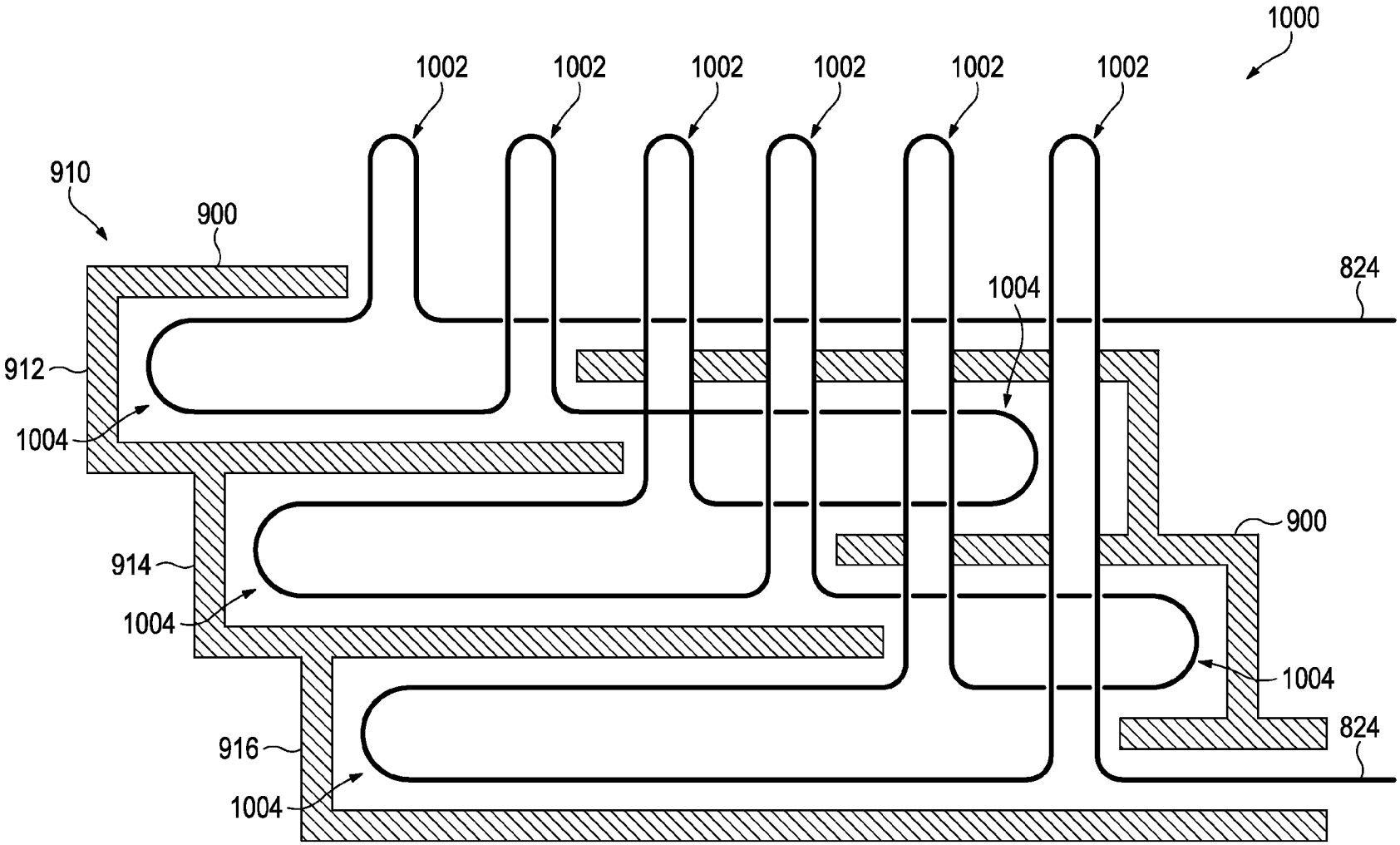
FIG. 10 is a representative diagram of an exemplary embodiment of a configuration for a tensile element to be vertically inlaid in a knitted component.

Referring now to FIG. 10, a representative diagram of a configuration 1000 of a tensile element to be vertically inlaid in a knitted component is shown disposed within multiple pocket-like knit structures of auxiliary element 910. In this embodiment, configuration 1000 illustrates first pocket 912, second pocket 914, and third pocket 916 of auxiliary element 910 that have had a quantity of yarn 824 disposed within the pockets according to the process described above in FIGS. 9A through 9I. In an exemplary embodiment, in order for a tensile element to be vertically inlaid within the knit element of a knitted component, a portion of the tensile element is temporarily fixed or held in place while the remaining portion of the knitted component that includes the knit element is formed.

Accordingly, as shown in FIG. 10, yarn 824 may formed into a plurality of loops 1002 disposed along a top of auxiliary element 910. In an exemplary embodiment, plurality of loops 1002 of yarn 824 will become a plurality of looped portions of the vertically inlaid tensile element upon completion of the knitting of the knitted component, for example, plurality of looped portions 426 of inlaid tensile element 422 of knitted component 400, described above. Yarn 824 has been inlaid into first pocket 912, second pocket 914, and third pocket 916 in the alternating configuration shown in FIG. 10. In particular, each pocket includes a turn 1004 associated with yarn 824 that allows yarn 824 to continue through the multiple pockets of auxiliary element 910 in a substantially continuous manner.

Figure 14:
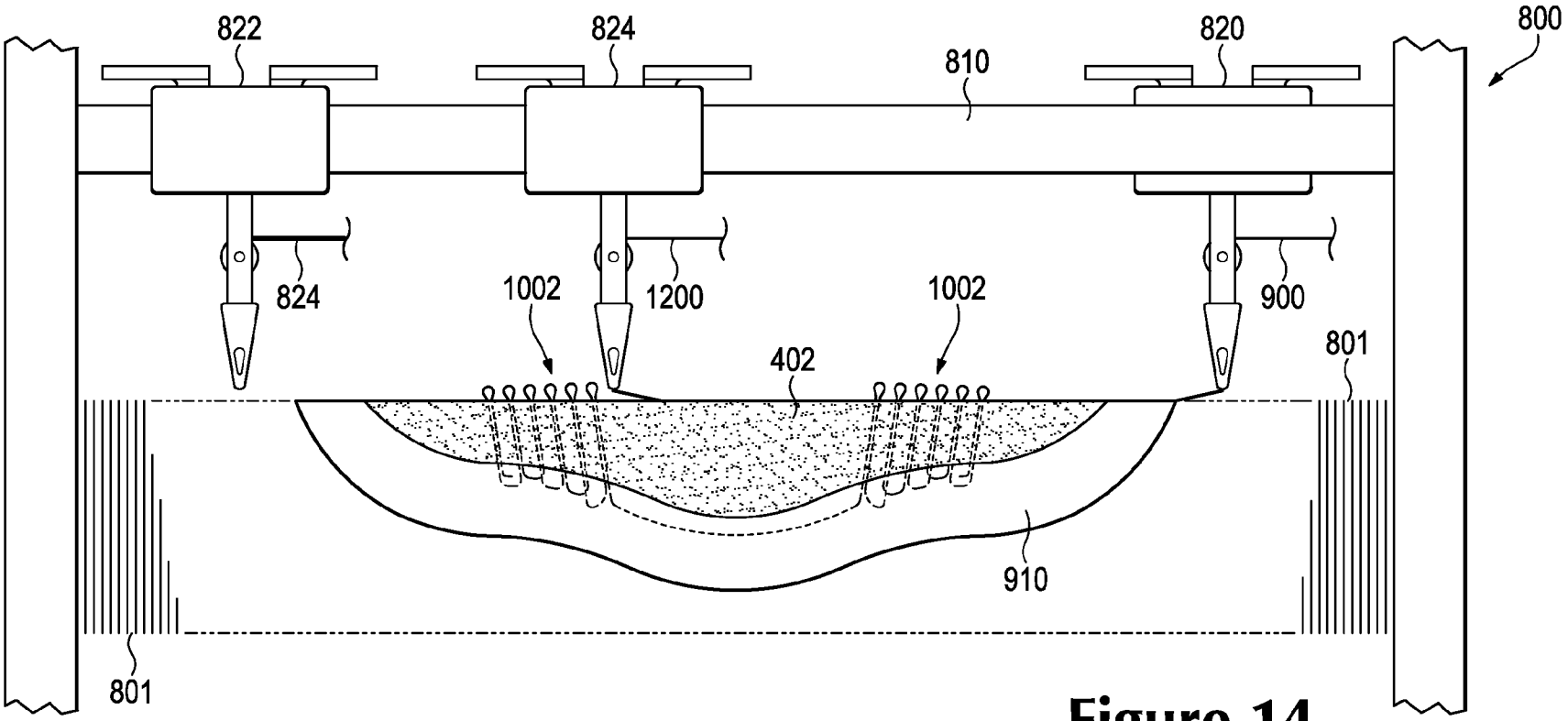
FIG. 14 is a schematic view of internal components of a knitting machine in operation to continue manufacturing the knitted component with a vertically inlaid tensile element.
Figure 15:
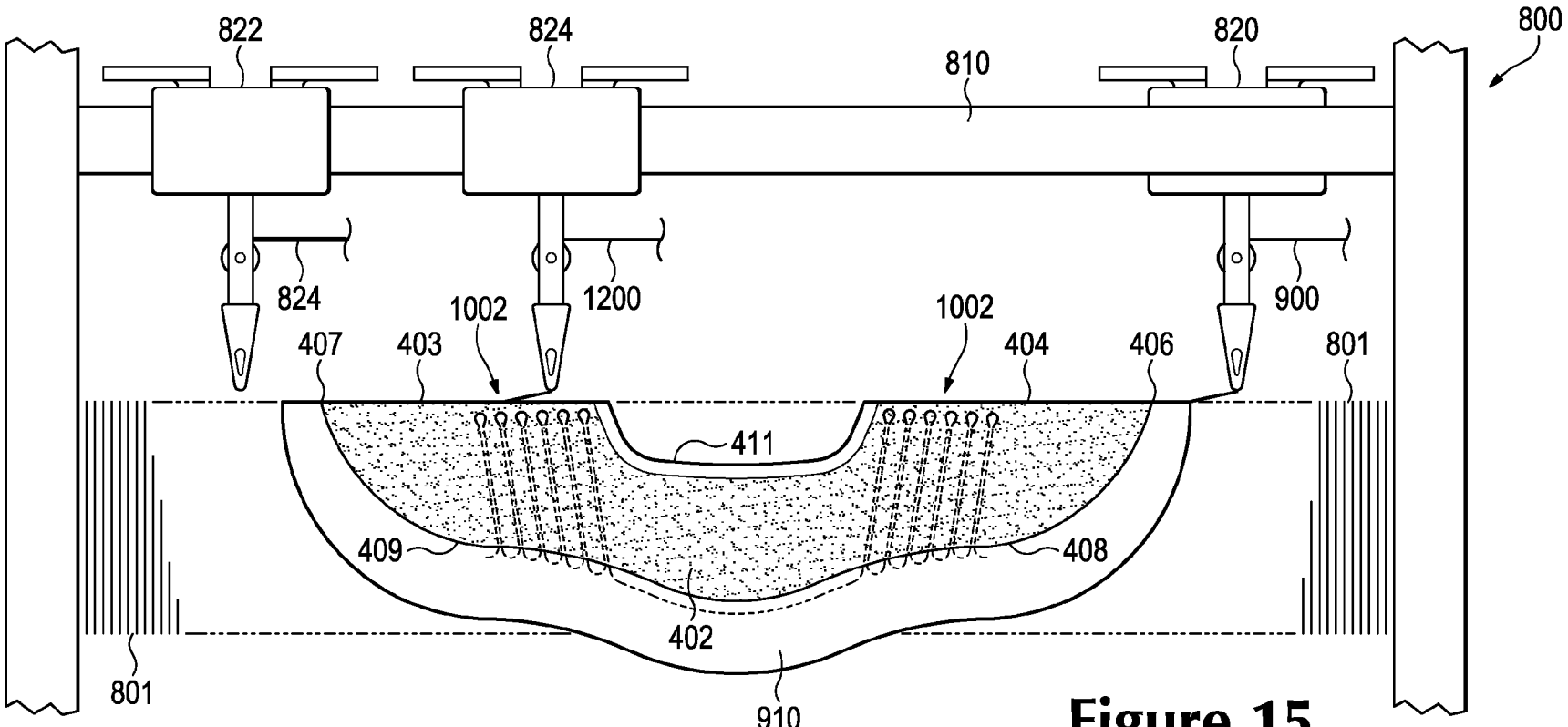
FIG. 15 is a schematic view of internal components of a knitting machine in operation to manufacture the knitted component with a vertically inlaid tensile element.
Figure 16:
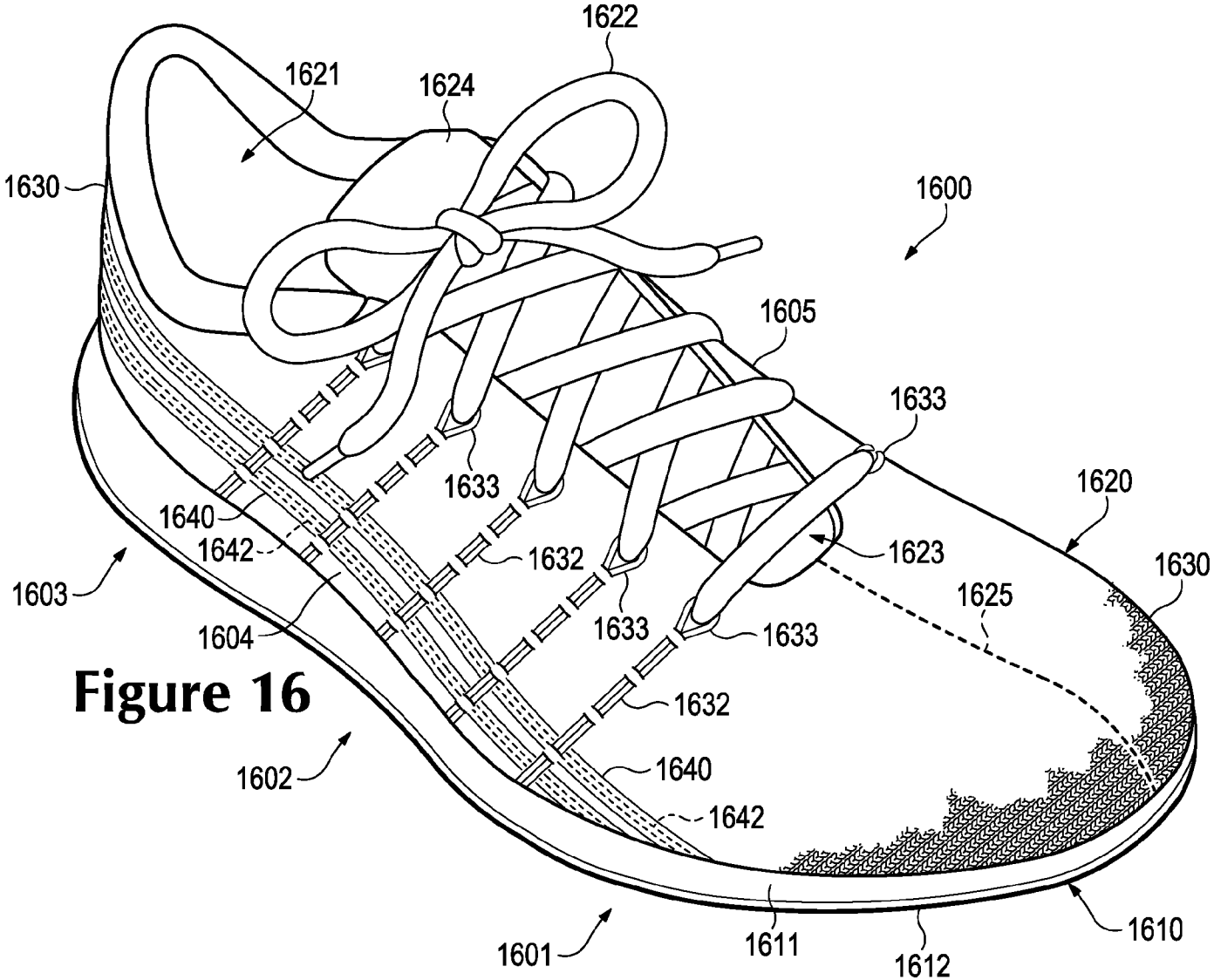
FIG. 16 is a an isometric view of an alternate embodiment of an article of footwear having a knitted component with a vertically inlaid tensile element and a horizontally inlaid tensile element.

FIGS. 11 through 15 illustrate an exemplary process of vertically inlaying a tensile element through knit element 402 of knitted component 400. The process may be used to form vertically inlaid tensile elements within a knit element of other embodiments of knitted components in a substantially similar manner. In addition, a conventional inlaying process may be used as disclosed in the Feeder cases above to further include one or more horizontally inlaid tensile elements in a knit element of a knitted component, for example, as shown in the embodiment of FIGS. 16 though 22B, below.

Figure 11:
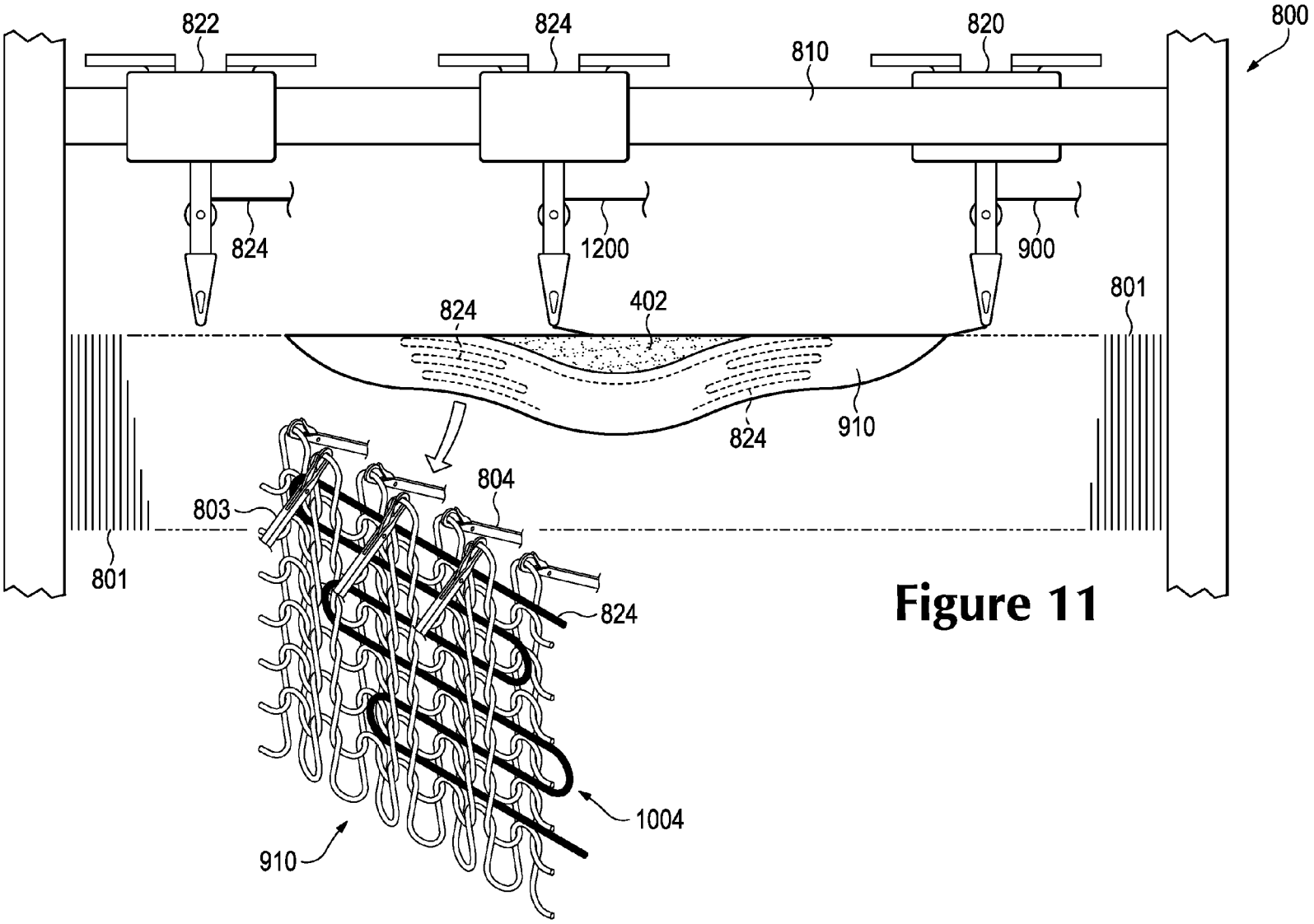
FIG. 11 is a schematic view of internal components of a knitting machine in operation to manufacture a knitted component with a vertically inlaid tensile element.

Referring now to FIG. 11, knitting process described above with regard to FIGS. 9A through 9I may be used to form auxiliary element 910 that includes a plurality of pocket-like knit structures containing yarn 824 that is used to form the vertically inlaid tensile elements. In this embodiment, a portion of knitting machine 800 is shown that includes front bed 801, needles 803, 804, forward rail 810, standard feeder 820, and combination feeder 822. In addition, in this embodiment, at least one additional standard feeder, including a second standard feeder 824, may be used to form portions of knitted component 400. Second standard feeder 824 may include a second yarn 1200 of any suitable type for forming knitted component. It should be understood that additional components of knitting machine 800, as well as additional standard and/or combination feeders, not shown here may be used in similar manner.

In this embodiment, standard feeder 820 has been used to form auxiliary element 910, thus second standard feeder 824 with second yarn 1200 is provided to form the remaining portion of knitted component 400 including knit element 402. In other embodiments, however, standard feeder 820 may continue to form the remaining portion of knitted component 400 using the same yarn, yarn 900, as used to form auxiliary element 910. As shown in FIG. 11, after auxiliary element 910 has been formed, including inlaying a quantity of yarn 824 within the pocket-like structures of auxiliary element 910, second feeder 824 may begin to form a portion of knit element 402.

Figure 12:
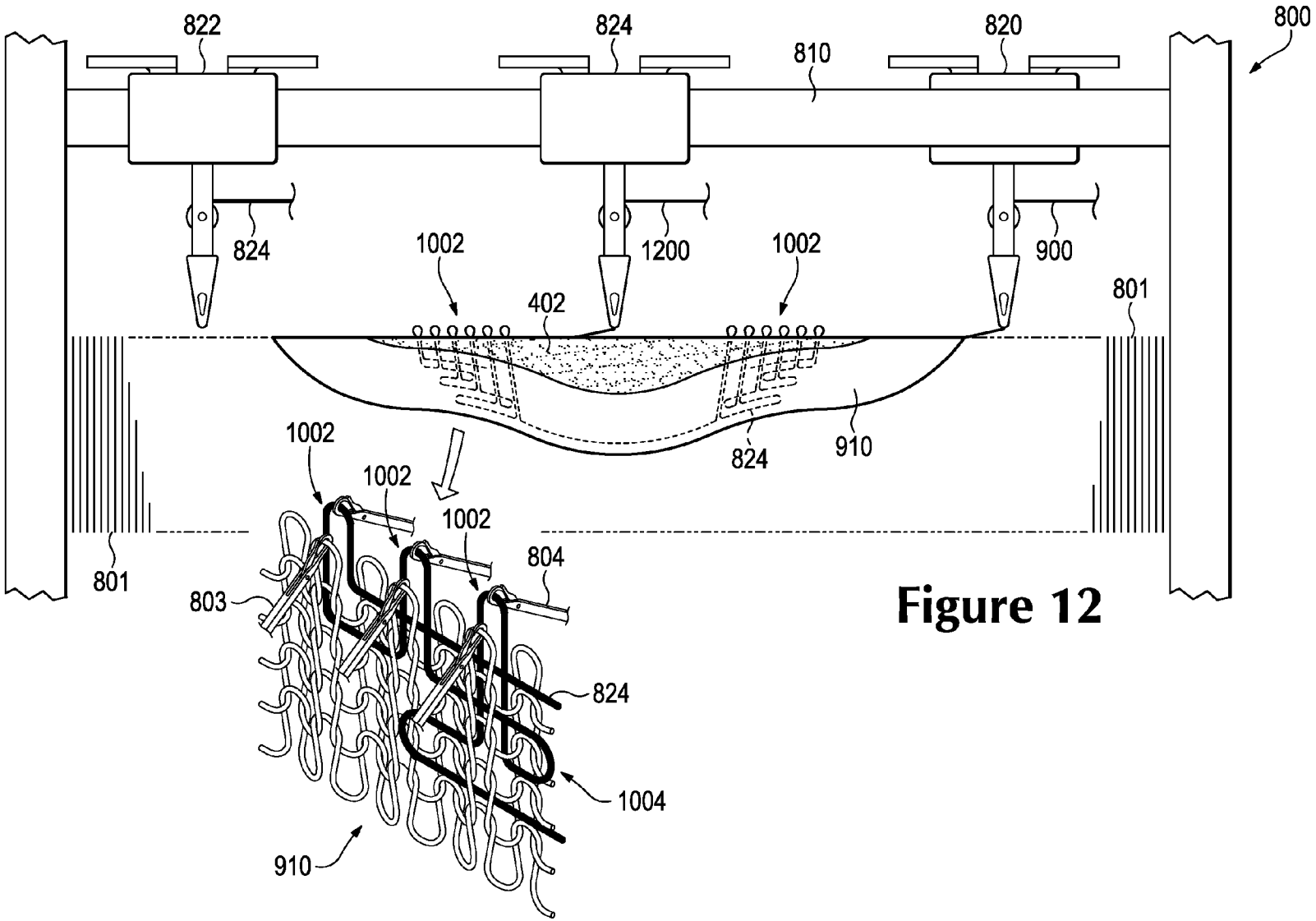
FIG. 12 is a schematic view of internal components of a knitting machine in operation to manufacture the knitted component with a vertically inlaid tensile element.
Figure 13:
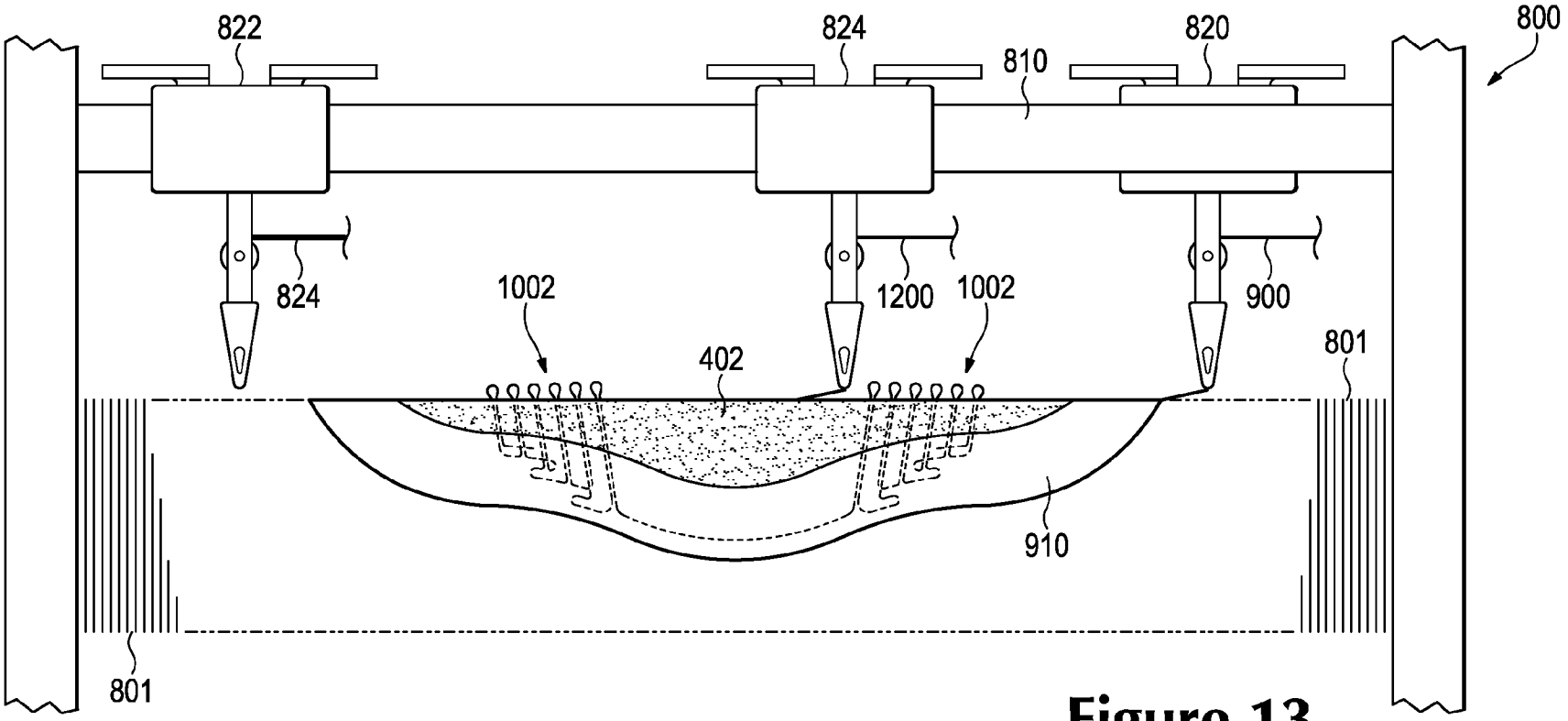
FIG. 13 is a schematic view of internal components of a knitting machine in operation to continue manufacturing the knitted component with a vertically inlaid tensile element.

Next, yarn 824 disposed within the pocket-like structures of auxiliary element 910 are prepared to be vertically inlaid within knit element 402. As shown in FIG. 12, needles 804 (alternatively, or additionally, needles 803) may hold plurality of loops 1002 of yarn 824 on back bed 802 of knitting machine 800 (alternatively, or additionally, on front bed 801) in an approximately fixed position. Accordingly, as second standard feeder 824 knits additional courses of yarn 1200 that form knit element 402 in FIG. 13, yarn 824 is held by plurality of loops 1002 on needles 804 of knitting machine 800 in the fixed position. As knitted component 400 moves downward as new courses forming knit element 402 are made, yarn 824 spools or feeds out of the pocket-like structures of auxiliary element. Thus, as shown in FIG. 14, as more of knit element 402 is formed, more of yarn 824 is extracted or pulled free from the pocket-like structures of auxiliary element 910 and incorporated into knitted component 400 as vertically inlaid tensile elements 422.

The process described for holding plurality of loops 1002 of yarn 824 on needles 803, 804 of needle beds 801, 802 in the fixed position as the remaining portion of knitted component 400 including knit element 402 is formed may be repeated as many times as is desired to form knit element 402 of knitted component 400 of a specific size and/or shape. Referring now to FIG. 15, once knitted component 400 reaches the desired dimensions, plurality of loops 1002 of yarn 824 may be released from needles 803, 804 to become plurality of looped portions 426 of tensile element 422. Additionally, in some embodiments, yarn 1200 may be used to secure looped portions 426 to a portion of knit element 402 so as to anchor tensile element 422 to knitted component 400.

In some embodiments, auxiliary element 910 may be a portion of knitted component 400 that is discarded after the knitting process and does not become part of an upper of an article of footwear. For example, in some cases, auxiliary element 910 may be removed or cut from one or more of the perimeter edges of knitted component 400. In other cases, auxiliary element 910 may be configured so as to unravel from completed knitted component 400. In still other cases, auxiliary element 910 may be incorporated into a portion of a strobel sock or other structure for an article of footwear.

By forming a knitted component, for example, knitted component 400, using the exemplary knitting process described herein, an upper for an article of footwear having a flattened or wide U-shaped configuration may be formed using a smaller number of courses than an upper formed having a conventional U-shaped configuration. Because the vertical inlay process allows a tensile element to be disposed through the portion of the knitted component that will provide support to an upper, a knitted component including an upper may be more efficiently formed with the flattened or wide U-shaped configuration.

Alternate Configurations

In some embodiments, a knitted component with a vertically inlaid tensile element may have other configurations. FIGS. 16 through 22B illustrate an alternate embodiment of a knitted component that includes a knit element having a vertically inlaid tensile element and a horizontally inlaid tensile element. In some embodiments, a horizontally inlaid tensile element may be configured to provide strength, support, and/or stability to additional portions of an upper of a knitted component. For example, a horizontally inlaid tensile element may be configured to extend around a heel region of a knitted component to provide additional support and/or structure to the heel region of the upper.

Figure 17:
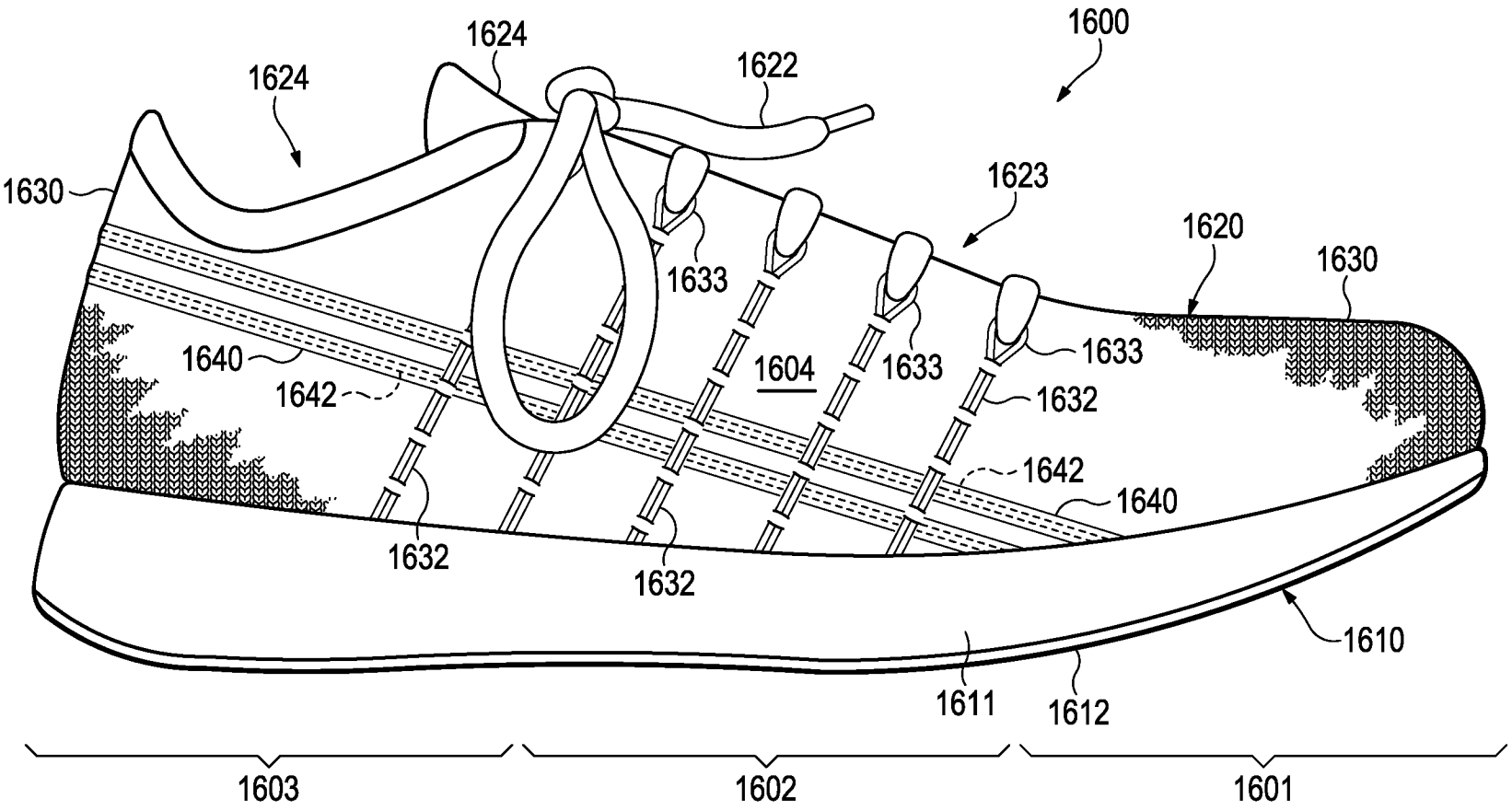
FIG. 17 is a lateral side view of an alternate embodiment of the article of footwear.
Figure 18:
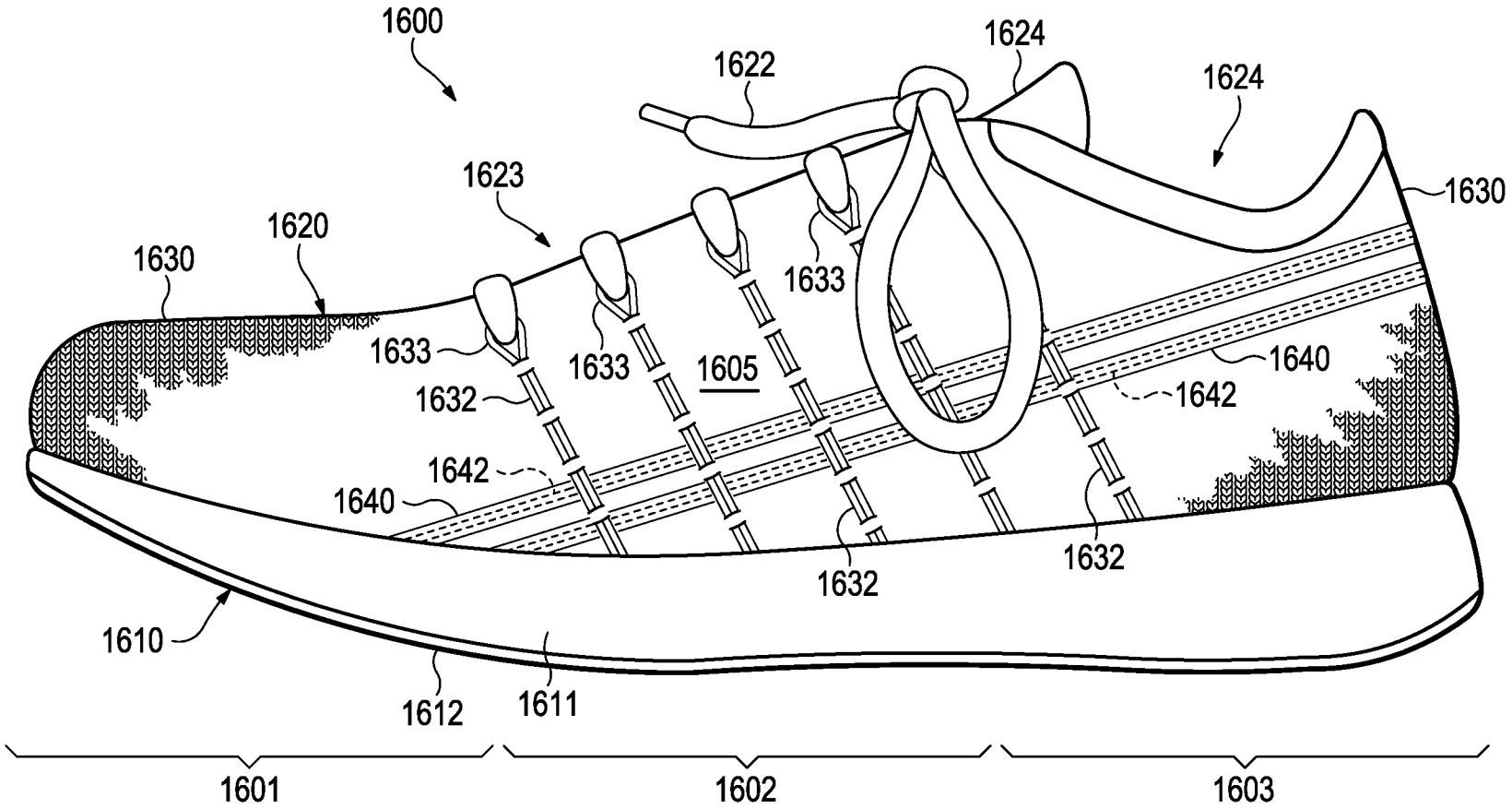
FIG. 18 is a medial side view of an alternate embodiment of the article of footwear.

Referring now to FIGS. 16 through 18, an alternate embodiment of an article of footwear 1600, also referred to simply as footwear 1600 that incorporates a knitted component 1620 having at least a vertically inlaid tensile element 1632 and a horizontally inlaid tensile element 1642 is illustrated. Article of footwear 1600 may include one or more components that are substantially similar to like components of footwear 100, described above. For example, in some embodiments, footwear 1600 may include a sole structure 1610, including a midsole 1611 and an outsole 1612, that is substantially similar to sole structure 110, including midsole 111 and outsole 112, described above. Additionally, footwear 1600 may be any type of footwear disclosed above with reference to footwear 100. For reference purposes, footwear 1600 may be divided into three general regions: a forefoot region 1601, a midfoot region 1602, and a heel region 1603, as shown in FIGS. 16 through 18, that are associated with substantially similar portions of footwear 1600 as forefoot region 101, midfoot region 102, and heel region 103, described above. Similarly, footwear 1600 may be associated with a lateral side 1604 and a medial side 1605 that are associated with substantially similar sides of footwear 1600 as lateral side 104 and medial side 105.

In some embodiments, sole structure 1610 is secured to an upper 1620 and extends between the foot and the ground when footwear 1600 is worn. In some embodiments, upper 1620 defines a void within footwear 1600 for receiving and securing a foot relative to sole structure 1610. Access to the void is provided by an ankle opening 1621 located in at least heel region 1603. In some embodiments, a throat area 1623 extends from ankle opening 1621 in heel region 1603 over an area corresponding to an instep of the foot to an area adjacent to forefoot region 1601. In an exemplary embodiment, vertically inlaid tensile element 1632 may be associated with portions of upper 1620, as will be described in more detail below. In one embodiment, vertically inlaid tensile element 1632 extend from sole structure 1610 to an area adjacent to throat area 1623 and may be associated with portions of lateral side 1604 and/or medial side 1605 of upper 1620.

Additionally, in an exemplary embodiment, horizontally inlaid tensile element 1642 may further be associated with portions of upper 1620, including knit structures 1640, as will be described below. In one embodiment, horizontally inlaid tensile element 1642 may extend from an area of upper 1620 in forefoot region 1601 that is adjacent to sole structure 1610 on lateral side 1604 (shown in FIG. 17) extending along upper 1620 in approximately a longitudinal direction to heel region 1603. Horizontally inlaid tensile element 1642 may further extend around upper 1620 at heel region 1603 and continue in the longitudinal direction to an area of upper 1620 in forefoot region 1601 that is adjacent to sole structure 1610 on medial side 1605 (shown in FIG. 18).

Footwear 1600 may include other elements associated with footwear 100, described above. For example, a lace 1622 may extend through various lace apertures 1633 in upper 1620 and/or looped portions of tensile element 1632 to permit a wearer to modify dimensions of upper 1620 to accommodate proportions of the foot. More particularly, lace 1622 permits the wearer to tighten upper 1620 around the foot, and lace 1622 permits the wearer to loosen upper 1620 to facilitate entry and removal of the foot from the void (i.e., through ankle opening 1621). In addition, a tongue 1624 of upper 1620 extends under lace 1622 to enhance the comfort of footwear 1600. In further configurations, upper 1620 may include additional elements associated with an article of footwear, including additional elements described for use with upper 120 of footwear 100 above.

Figure 19:
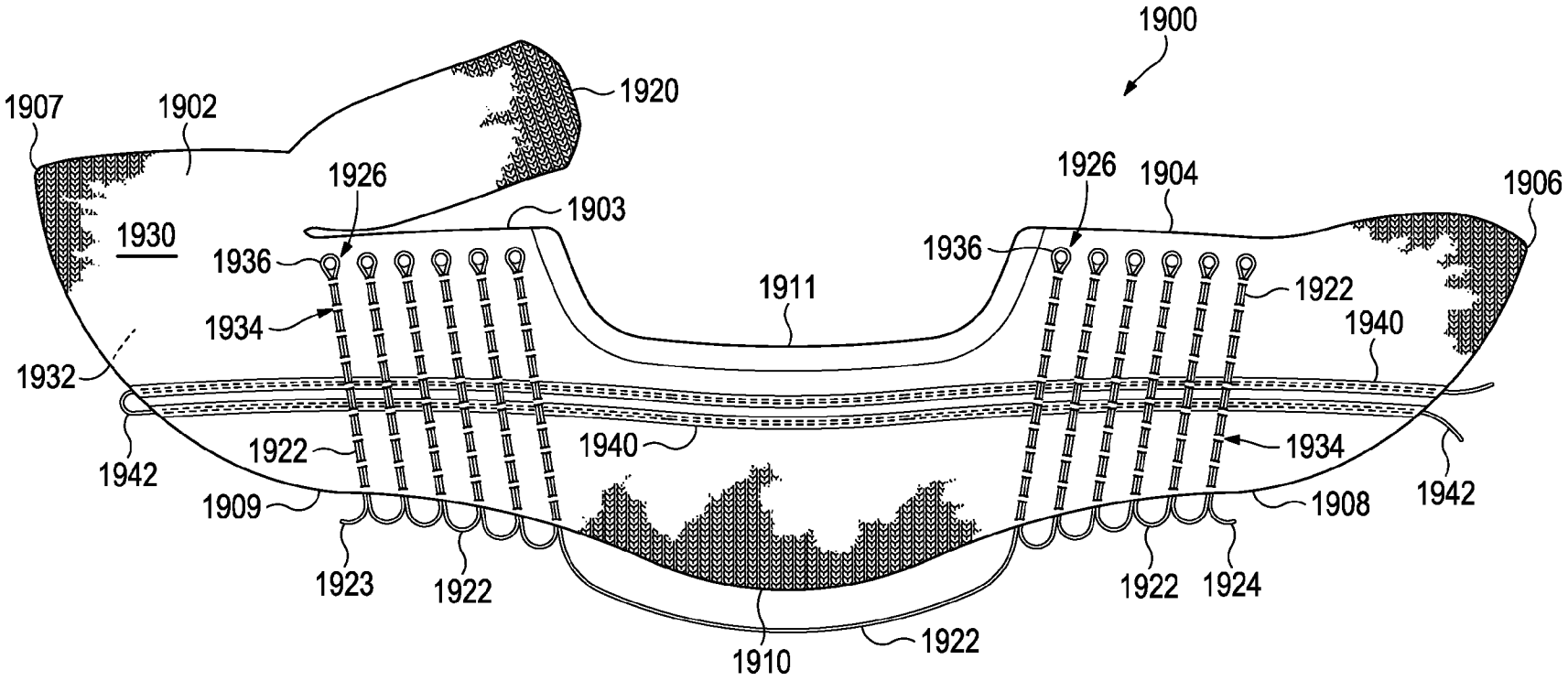
FIG. 19 is a top plan view of an alternate embodiment of a knitted component with a vertically inlaid tensile element and a horizontally inlaid tensile element.
Figure 20:
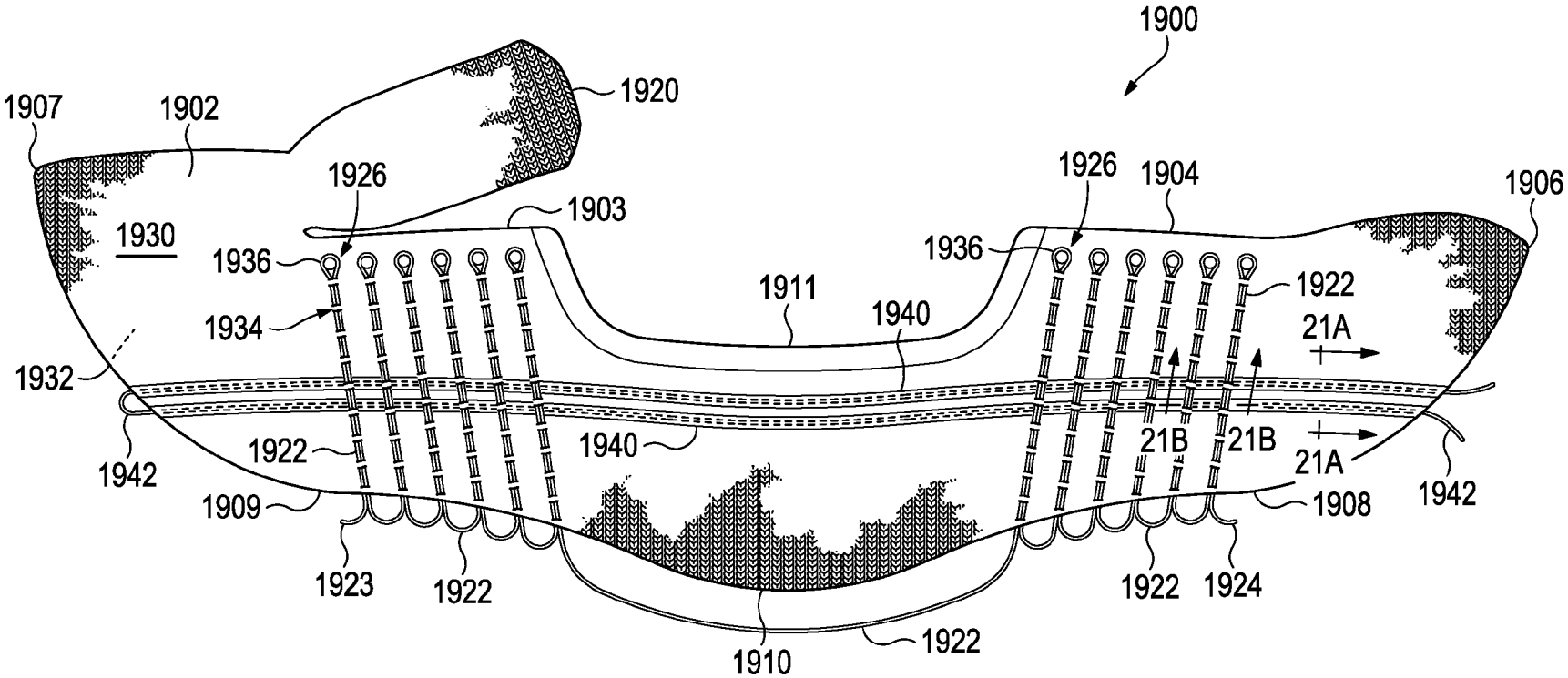
FIG. 20 is a top plan view of an alternate embodiment of a knitted component with a vertically inlaid tensile element and a horizontally inlaid tensile element illustrating the location of section lines 21A and 21B.

Referring now to FIGS. 19 and 20, a knitted component 1900 is depicted separate from a remainder of footwear 1600. Knitted component 1900 is formed of unitary knit construction. In some embodiments, knitted component 1900 may have an arrangement that is substantially similar to the arrangement of knitted component 400, described above, including a knit element 1902 forming a majority of knitted component 1902 that is substantially similar to knit element 402. In contrast to knitted component 400, however, knitted component 1900 may include both a vertically inlaid tensile element 1922, which may be substantially similar to inlaid tensile element 422, and a horizontally inlaid tensile element 1942. In an exemplary embodiment, horizontally inlaid tensile element 1942 may be disposed through one or more knit structures 1940 within knit element 1902 of knitted component 1900.

In some embodiments, knit element 1902 may have a flattened or wide U-shaped configuration, as described above. In an exemplary embodiment, the flattened U-shaped configuration of knit element 1902 is outlined by a perimeter edge, including a lateral top midfoot perimeter edge 1904, a lateral forefoot perimeter edge 1906, a lateral bottom midfoot perimeter edge 1908, a heel perimeter edge 1910, a medial bottom midfoot perimeter edge 1909, a medial forefoot perimeter edge 1907, a medial top midfoot perimeter edge 1903, and an ankle perimeter edge 1911. In addition, in some embodiments, knit element 1902 may further include a tongue portion 1920 that may be formed of unitary knit construction with knit element 1902.

When incorporated into an article of footwear, including footwear 1600, lateral bottom midfoot perimeter edge 1908 and medial bottom midfoot perimeter edge 1909, and at least a portion of lateral forefoot perimeter edge 1906, heel perimeter edge 1910, and medial forefoot perimeter edge 1907 lays against an upper surface of a midsole and is joined to a strobel sock (e.g., midsole 1611, described above). In addition, portions of lateral forefoot perimeter edge 1906 and medial forefoot perimeter edge 1907 adjacent to lateral top midfoot perimeter edge 1904 and medial top midfoot perimeter edge 1903 are joined to each other and extend longitudinally from the forefoot region towards the midfoot region. In some configurations of footwear, a material element may cover a seam between lateral forefoot perimeter edge 1906 and medial forefoot perimeter edge 1907 to reinforce the seam and enhance the aesthetic appeal of the footwear. Ankle perimeter edge 1911 forms an ankle opening, including ankle opening 1621 described above.

Knitted component 1900 may have a first surface 1930 and an opposite second surface 1932. First surface 1930 forms a portion of the exterior surface of the upper, whereas second surface 1932 forms a portion of the interior surface of the upper, thereby defining at least a portion of the void within the upper. Additionally, in some embodiments, knitted component 1900 may further include a plurality of lace apertures 1936 in knit element 1902 that extend through from first surface 1930 to second surface 1932. In an exemplary embodiment, lace apertures 1936 may be substantially similar to lace apertures 436, described above, including any suitable structure for lace apertures 436.

Referring again to FIGS. 19 and 20, vertically inlaid tensile element 1922 may form one or more loops at various portions of knitted component 1900 in a similar manner as inlaid tensile element 422 of knitted component 400. Accordingly, in this embodiment, vertically inlaid tensile element 1922 repeatedly exits knit element 1902 at lateral bottom midfoot perimeter edge 1908 and/or medial bottom midfoot perimeter edge 1909 and then re-enters knit element 1902 at another location of lateral bottom midfoot perimeter edge 1908 and/or medial bottom midfoot perimeter edge 1909, thereby forming loops along lateral bottom midfoot perimeter edge 1908 and/or medial bottom midfoot perimeter edge 1909. Similarly, vertically inlaid tensile element 1922 may also include a plurality of looped portions 1926 disposed adjacent to lateral top midfoot perimeter edge 1904 and/or medial top midfoot perimeter edge 1903, where vertically inlaid tensile element 1922 turns and extends back towards lateral bottom midfoot perimeter edge 1908 and/or medial bottom midfoot perimeter edge 1909.

In an exemplary embodiment, horizontally inlaid tensile element 1942 may extend from a portion of knitted component 1900 between lateral forefoot perimeter edge 1906 and bottom midfoot perimeter edge 1908 and continue through a substantially majority of knit element 1902 to an opposite side. At the opposite side, horizontally inlaid tensile element 1942 may exit knit structure 1940 of knit element 1902 and re-enter knit element 1902 at another location between medial forefoot perimeter edge 1907 and medial bottom midfoot perimeter edge 1909 and extend back across knitted component 1900 to the side where horizontally inlaid tensile element 1942 entered knit element 1902.

Figure 21A:
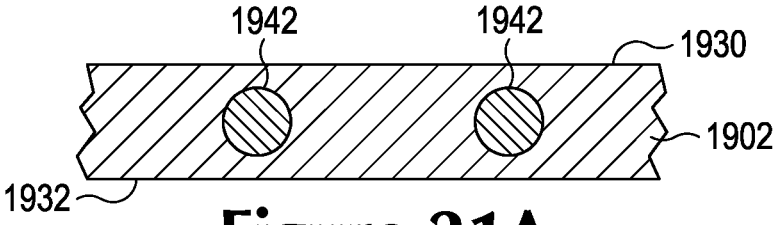
FIG. 21A is a cross-sectional view of the knitted component with a vertically inlaid tensile element and a horizontally inlaid tensile element, as defined by section line 21A in FIG. 20.
Figure 21B:
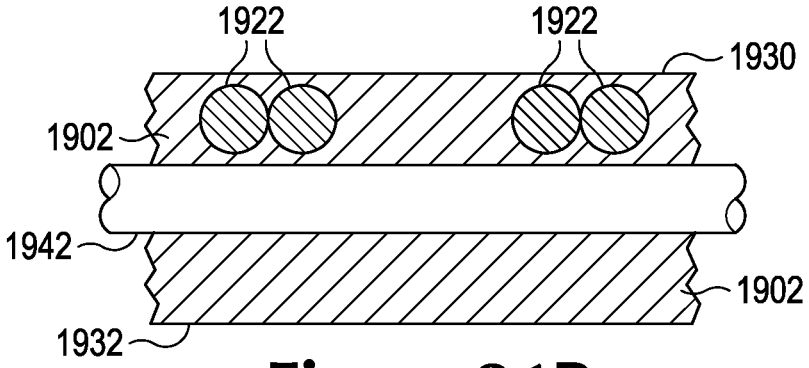
FIG. 21B is a cross-sectional view of the knitted component with a vertically inlaid tensile element and a horizontally inlaid tensile element, as defined by section line 21B in FIG. 20.

In some embodiments, vertically inlaid tensile element 1922 may extend through knit element 1902 and pass between various portions of knit element 1902, including apertures 1934 in knit element 1902, in a similar manner as described with reference to knitted component 400 above. For example, vertically inlaid tensile element 1922 may extend through portions of knit element 1902, as depicted in FIG. 21A. Further, vertically inlaid tensile element 1922 may also alternately pass between various apertures 1934 within knit element 1902, in a substantially similar manner as depicted in FIG. 6B above. Additionally, in this embodiment, horizontally inlaid tensile element 1942 may be located within knit structures 1940 of knit element 1902 between first surface 1930 and second surface 1932, as depicted in FIG. 21B.

Vertically inlaid tensile element 1922 may be formed with knit element 1902 of knitted component 1900 in a substantially similar manner as tensile element 422 of knitted component 400, described with reference to FIGS. 9A through 9I and FIGS. 10 through 15 above. Additionally, horizontally inlaid tensile element 1942, as well as corresponding knit structures 1940, may be formed with knit element 1902 of knitted component 1900 using a combination feeder, such as combination feeder 822 above, according to the inlaying process described in the Feeder cases, which are incorporated by reference above. Similarly, a knitted component, such as knitted component 1900, may further include different knit structures or other features described in the Knitted Component cases, which are also incorporated by reference above.

Figure 22A:
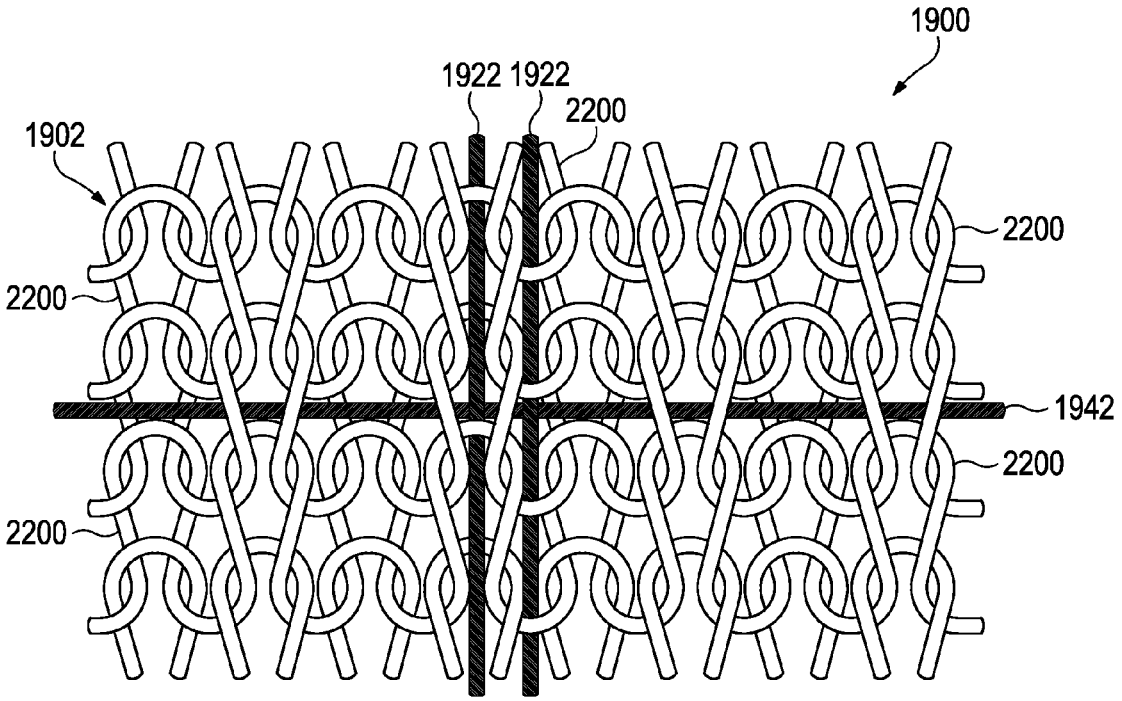
FIGS. 22A and 22B are plan views showing a knit structure with a vertically inlaid tensile element and a horizontally inlaid tensile element of a knitted component.

An example of a suitable configuration for a portion of knitted component 1900 is depicted in FIG. 22A. In this configuration, knit element 1902 includes a yarn 2200 that forms a plurality of intermeshed loops defining multiple horizontal courses and vertical wales. In this embodiment, vertically inlaid tensile element 1922 extends vertically along the direction of one of the wales and extends vertically back along the direction of another of the wales, while horizontally inlaid tensile element 1942 extends along the direction of one of the courses of knit element 1902. In an exemplary embodiment, vertically inlaid tensile element 1922 and/or horizontally inlaid tensile element 1942 may alternate between being located (a) behind loops formed from yarn 2200 and (b) in front of loops formed from yarn 2200. For example, as shown in FIGS. 19 and 20, vertically inlaid tensile element 1922 weaves through the structure formed by knit element 1902 and horizontally inlaid tensile element 1942 may be disposed between first surface 1930 and second surface 1932 of knit element 1902. Although yarn 2200 forms each of the courses in this configuration, additional yarns may form one or more of the courses or may form a portion of one or more of the courses.

Figure 22B:
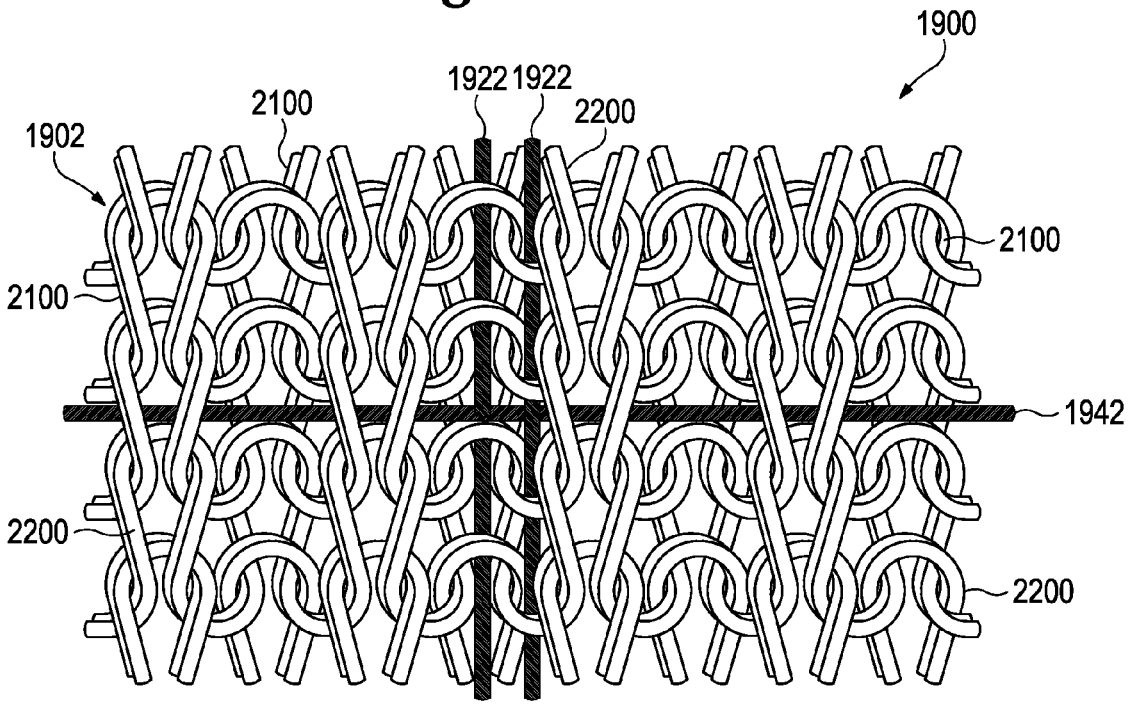

Another example of a suitable configuration for a portion of knitted component 1900 is depicted in FIG. 22B. In this configuration, knit element 1902 includes first yarn 2200 and a second yarn 2201. First yarn 2200 and second yarn 2201 are plated and cooperatively form a plurality of intermeshed loops defining multiple horizontal courses and vertical wales. That is, first yarn 2200 and second yarn 2201 run parallel to each other. As with the configuration in FIG. 22A, vertically inlaid tensile element 1922 extends vertically along the direction of one of the wales and extends vertically back along the direction of another of the wales, while horizontally inlaid tensile element 1942 extends along the direction of one of the courses of knit element 1902. In an exemplary embodiment, vertically inlaid tensile element 1922 and/or horizontally inlaid tensile element 1942 may alternate between being located (a) behind loops formed from first yarn 2200 and second yarn 2201 and (b) in front of loops formed from first yarn 2200 and second yarn 2201.

In some embodiments, a vertically inlaid tensile element may be disposed approximately diagonally through a knit element rather than strictly vertical or perpendicular to the direction of knitting the knitted component. That is, a tensile element may pass vertically through multiple different wales of a knit element through the knitted component. For example, FIGS. 23 and 24 illustrate an alternate knit structure and knitting process that may be used to inlay a vertically inlaid tensile element approximately diagonally through a knit element.

Figure 23:
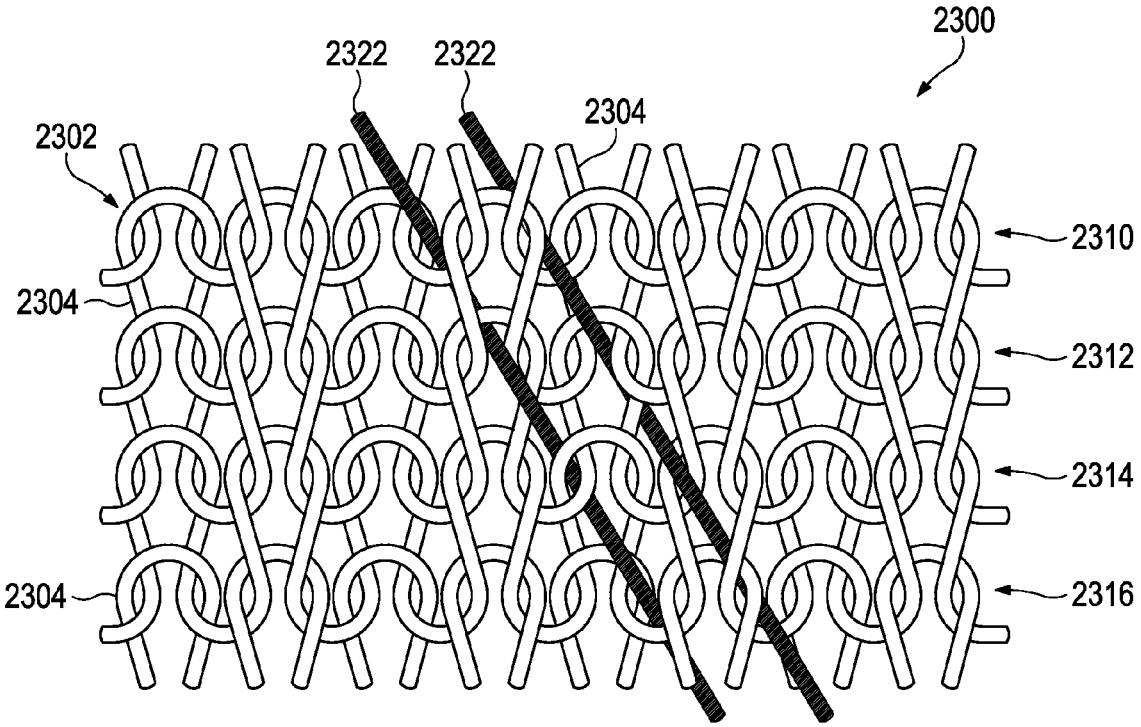
FIG. 23 is a plan view showing a knit structure with an alternate embodiment of a vertically inlaid tensile element disposed diagonally through the knit structure.
Figure 24:
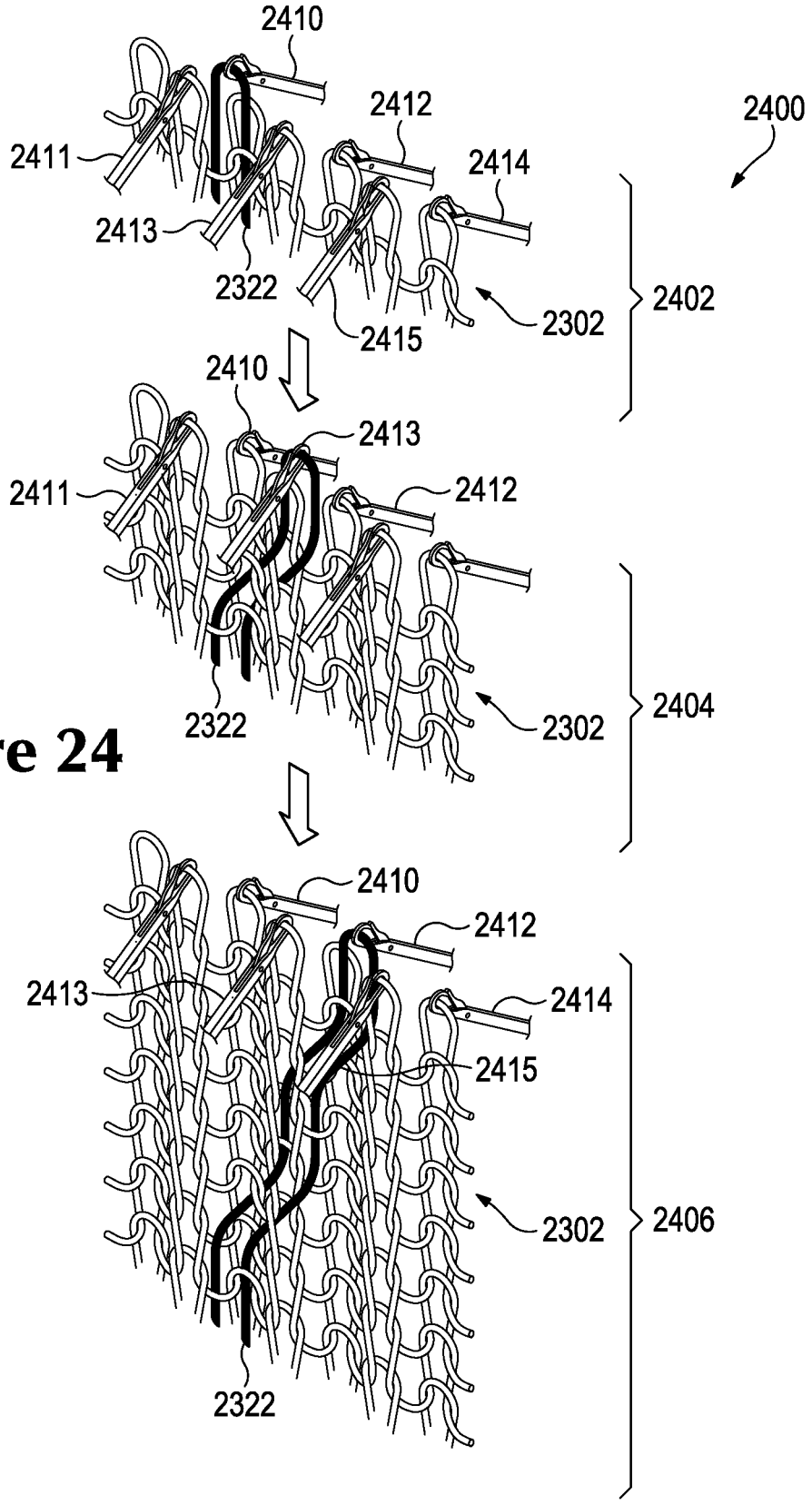
FIG. 24 is a schematic view of an exemplary embodiment of a process of forming a knit structure having a vertically inlaid tensile element diagonally through the knit structure.

Referring now to FIG. 23, an example of a suitable configuration for a portion of knitted component 2300 having a diagonally inlaid tensile element 2322 is illustrated. In this configuration, a knit element 2302 includes a yarn 2304 that forms a plurality of intermeshed loops defining multiple horizontal courses and vertical wales. In this embodiment, knit element 2302 may be described as having a first course 2310, a second course 2312, a third course 2314, and fourth course 2316 formed from a plurality of intermeshed loops of yarn 2304. In contrast to the knit structure in FIG. 7A, in FIG. 23, diagonally inlaid tensile element 2322 extends diagonally along the direction of multiple adjacent wales and similarly extends diagonally back along the direction of other multiple adjacent wales.

For example, diagonally inlaid tensile element 2322 may extend from one wale at first course 2310 to an adjacent wale at second course 2312. Similarly, diagonally inlaid tensile element 2322 may extend from the wale at second course 2312 to another adjacent wale at third course 2314 and continuing in this manner through fourth course 2316. For purposes of illustration, diagonally inlaid tensile element 2322 is shown shifting from one wale to an adjacent wale between consecutive courses. However, it should be understood that diagonally inlaid tensile element 2322 may extend vertically along the direction of the same wale through any desired portion of knit element 2302 spanning multiple courses before shifting to extend a direction along a different wale of knit element 2302.

While FIG. 23 illustrates one example of diagonally inlaid tensile element 2322 disposed in knit component 2300 having the configuration shown, it should be understood that a substantially similar arrangement may be provided with knit component having a plated configuration, such as a configuration similar to the embodiments illustrated in FIGS. 7B and 22B, described above.

FIG. 24 illustrates an exemplary embodiment of a knitting process that may be used to diagonally inlay a tensile element, including diagonally inlaid tensile element 2322. In one embodiment, a diagonal inlay knitting process 2400 may be performed with a knitting machine, such as knitting machine 800, described above. In an exemplary embodiment, diagonal inlay process 2400 may described with reference to a portion of knitted component 2300 that includes tensile element 2322 extending through knit element 2302. For purposes of illustration of diagonal inlay process 2400 in FIG. 24, some of the needles used to hold portions of knit element 2302 may not be shown. It should be understood that additional needles may be used during diagonal inlay process 2400 and/or the knitting process forming knitted component 2300.

In this embodiment, knit element 2302 may be formed using needles 803, 804 of knitting machine 800, including a first back needle 2410, a second back needle 2412, and a third back needle 2414 associated with back needle bed 802 and a first front needle 2411, a second front needle 2413, and a third front needle 2415 associated with front needle bed 801. In a first step 2402, knitted component 2300 includes knit element 2302 and tensile element 2322 having a loop 2401 that is being held by first back needle 2410.

In order for tensile element 2322 to be transferred to an adjacent wale during knitting of subsequent courses of knit element 2302 so as to be diagonally inlaid, loop 2401 of tensile element 2322 is passed to an adjacent needle of needle beds 801, 802. According, in a second step 2404, loop 2401 of tensile element 2322 is passed from first back needle 2410 to second front needle 2413 associated with front bed 801. From second step 2404, loop 2401 of tensile element 2322 may then be passed back to an adjacent needle on back bed 802. As shown in a third step 2406, loop 2401 of tensile element 2322 is passed from second front needle 2413 to second back needle 2412 associated with back bed 802. By repeating process 2400 multiple times, tensile element 2322 may be shifted from extending along one wale of knit element 2302 to extending along a different wale of knit element 2302 to form a diagonally inlaid tensile element for knitted component 2300.

As described in reference to FIG. 24, diagonal inlay knitting process 2400 transferred loop 2401 of tensile element 2322 to an adjacent needle. However, in other embodiments, diagonal inlay knitting process 2400 may be used to transfer a loop of a tensile element to needles on a bed of a knitting machine that are separated by different distances. Accordingly, in different embodiments, the angle that the diagonally inlaid tensile element extends through a knit element of a knitted component may be determined based on the distance between the needles that transfer the loops of the tensile element. For example, in some cases, a loop may be passed from one needle on a back bed to another needle on the back bed that are separated from each other by from 1 needle to 15 needles or more. With this arrangement, the distance between the needles may be a larger or smaller distance to correspondingly increase or decrease the angle of the diagonally inlaid tensile element through the knit element of the knitted component.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of knitting using a knitting machine comprising:

knitting a knit element along a first direction by using a plurality of needles of the knitting machine to manipulate at least one yarn to form a plurality of courses and wales;

disposing at least one tensile element through the knit element;

holding the at least one tensile element with at least one needle of the plurality of needles;

extracting a portion of the at least one tensile element from below the at least one needle such that the portion of the at least one tensile element changes orientation from the first direction to a second direction;

wherein the portion of the at least one tensile element remains in a fixed position along the second direction as additional courses of the knit element are formed using the plurality of needles of the knitting machine; and wherein the second direction is different from the first direction.

2. The method recited in claim 1, wherein the step of producing the knit element comprises using at least one feeder associated with the knitting machine to form the plurality of courses and wales; and wherein the step of holding comprises using the at least one needle associated with the plurality of needles of the knitting machine to hold the at least one tensile element in the fixed position;

wherein the at least one tensile element forms a loop on the at least one needle.

3. The method recited in claim 2, wherein the tensile element includes a first portion that extends along the second direction and a second portion that extends along the second direction, the first portion passing through at least a first course and the first portion passing through at least a second course, the second portion passing through at least the first course and the second portion passing through at least the second course.

4. The method recited in claim 1, wherein the method further comprises:

producing an auxiliary element by manipulating at least one second yarn to form a second plurality of courses and wales; and inlaying a quantity of the at least one tensile element within the second plurality of courses and wales.

5. The method recited in claim 4, wherein the step of producing the auxiliary element is performed prior to the step of producing the knit element.

6. The method recited in claim 4, wherein the step of holding the at least one tensile element using the at least one needle continues until the quantity of the at least one tensile element within the second plurality of courses and wales of the auxiliary element is extracted from the auxiliary element into the knit element.

7. The method recited in claim 4, further comprising:

continuing to form the plurality of courses and wales associated with the knit element to produce a knitted component having the at least one tensile element disposed through in the second direction; and removing the auxiliary element from the knitted component.

8. A method of manufacturing a knitted component for an article of footwear, the method comprising:

providing a knitting machine having a first feeder that dispenses a first yarn and a needle bed that includes a plurality of needles;

moving at least the first feeder along the needle bed in a first direction to form a first course of the knitted component from the first yarn;

holding a tensile element in a fixed position using at least one needle of the plurality of needles;

moving at least the first feeder along the needle bed in the first direction to form a second course of the knitted component while the tensile element is being held in the fixed position by the at least one needle;

wherein as the tensile element is held by the at least one needle in the fixed position along a second direction that is different from the first direction, the first feeder moves along the needle bed to form the second course; and wherein the first feeder forms additional courses along the first direction after the second course to continue manufacturing the knitted component, as the first feeder forms additional courses the at least one needle continues to hold the tensile element such that the tensile element extends through the knitted component along the second direction without interlooping with the first yarn.

9. The method recited in claim 8, further comprising:

providing the knitting machine with a second feeder that dispenses the tensile element; and moving at least the second feeder along the needle bed in the first direction to inlay a quantity of the tensile element within the first course of the knitted component; and wherein the step of moving at least the second feeder is performed prior to the step of holding the tensile element in the fixed position.

10. The method recited in claim 9, wherein the first course comprises at least a portion of an auxiliary element of the knitted component; and wherein the second course comprises at least a portion of a knit element of the knitted component.

11. The method recited in claim 9, wherein the step of moving at least the second feeder to inlay the quantity of tensile element is repeated multiple times to inlay the quantity of tensile element within an auxiliary element of the knitted component.

12. The method recited in claim 9, further comprising:

moving at least the first feeder along the needle bed in the first direction to form a plurality of courses of the knitted component while the tensile element is being held in the fixed position by the at least one needle; and wherein the tensile element inlaid within the first course is extracted from the first course as the first feeder forms the plurality of courses of the knitted component.

13. The method recited in claim 8, wherein the at least one needle holds a loop of the tensile element to keep the tensile element in the fixed position; and wherein the tensile element includes a first portion and a second portion, the first portion extending along the second direction;

the second portion extending along the second direction;

the first portion passing through the first course and the second course;

the second portion passing through the first course and the second course; and the loop extending between the first portion and the second portion.

14. The method recited in claim 8, wherein the first direction is approximately a horizontal direction; and wherein the second direction is approximately a vertical direction.

15. The method recited in claim 8, further comprising:

transferring the tensile element from the at least one needle to at least one second needle; and holding the tensile element in the fixed position along the second direction using the at least one second needle as the first feeder moves along the needle bed to form additional courses of the knitted component.

16. The method recited in claim 8, wherein the tensile element is held by the at least one needle in the fixed position along a direction of the wales of the knitted component.

17. A method of knitting using a knitting machine comprising:

knitting a knit element along a first direction by using a plurality of needles of the knitting machine to manipulate at least one yarn to form a plurality of courses and;

holding at least one first tensile element with at least one needle of the plurality of needles;

the at least one first tensile element being disposed through the knit element in a fixed position along a second direction that is approximately perpendicular to the first direction as at least a portion of the plurality of courses and wales of the knit element are produced;

a first end of the at least one first tensile element being located below the at least one needle and a second end of the at least one first tensile element being located below the at least one needle while the at least one first tensile element is held by the at least one needle; and inlaying at least one second tensile element within the portion of the plurality of courses of the knit element along the first direction.

18. The method recited in claim 17, wherein the at least one first tensile element is held in the fixed position along a direction of the wales of the knit element.

19. The method recited in claim 17, wherein a quantity of the at least one first tensile element is inlaid within an auxiliary element; and wherein the auxiliary element is produced prior to the step of producing the knit element.

20. The method recited in claim 19, wherein the step of holding the at least one first tensile element continues until the quantity of the at least one first tensile element within the auxiliary element is extracted.

21. A knitted component for an article of footwear comprising a knit element and at least one tensile element, the knitted component prepared by a process comprising the steps of:

producing the knit element along a first direction on a knitting machine by using a plurality of needles to manipulate at least one yarn to form a plurality of courses and wales; and holding the at least one tensile element disposed through the knit element in a fixed position along a second direction that is different from the first direction as at least a portion of the plurality of courses and wales of the knit element are produced;

the at least one tensile element forming a first loop along a first side of the knitted component, a first end and a second end of the at least one tensile element being located at a second side of the knitted component; and wherein the at least one tensile element is held by the first loop.

* * * * *